US008893994B2

(12) United States Patent
Matlin et al.

(10) Patent No.: US 8,893,994 B2
(45) Date of Patent: Nov. 25, 2014

(54) SHREDDER WITH ROTATABLE DEVICE FOR MOVING SHREDDED MATERIALS ADJACENT THE OUTLET

(75) Inventors: Tai Hoon K. Matlin, Round Lake Beach, IL (US); Shawn Applegate, Wood Dale, IL (US); James Waring, Libertyville, IL (US)

(73) Assignee: Fellowes, Inc., Itasca, IL (US)

( * ) Notice: Subject to any disclaimer, the term of this patent is extended or adjusted under 35 U.S.C. 154(b) by 525 days.

(21) Appl. No.: 13/208,984

(22) Filed: Aug. 12, 2011

(65) Prior Publication Data

US 2011/0290923 A1 Dec. 1, 2011

Related U.S. Application Data

(63) Continuation-in-part of application No. 13/089,030, filed on Apr. 18, 2011, now Pat. No. 8,113,449, which is a continuation of application No. 12/314,182, filed on Dec. 5, 2008, now Pat. No. 7,942,352.

(51) Int. Cl.
*B02C 18/22* (2006.01)
*B02C 18/00* (2006.01)

(52) U.S. Cl.
CPC ..... *B02C 18/0007* (2013.01); *B02C 2018/0061* (2013.01)
USPC ..... 241/30; 241/33; 241/100; 241/167; 241/236; 241/285.3

(58) Field of Classification Search
USPC ..... 241/100, 30, 236, 36, 222, 186.3, 33, 241/285.3
See application file for complete search history.

(56) References Cited

U.S. PATENT DOCUMENTS

| | | | | |
|---|---|---|---|---|
| 1,085,975 | A | 2/1914 | Dilg | |
| 1,706,935 | A | 3/1929 | Milne | |
| 2,081,460 | A | 5/1937 | Lorentz | |
| 7,150,422 | B2 | 12/2006 | Wang | |
| 7,762,485 | B2 * | 7/2010 | Huang | 241/100 |
| 7,942,352 | B2 | 5/2011 | Matlin et al. | |
| 2007/0029542 | A1 | 2/2007 | Yamada | |
| 2007/0295736 | A1 | 12/2007 | Wang | |
| 2008/0041988 | A1 | 2/2008 | Wang | |
| 2008/0156914 | A1 | 7/2008 | Huang | |

FOREIGN PATENT DOCUMENTS

| | | | |
|---|---|---|---|
| CN | 200610052985 | | 2/2007 |
| JP | 08-001027 | A | 1/1996 |
| JP | 2002-239405 | A | 8/2002 |
| JP | 2004-321993 | A | 11/2004 |

* cited by examiner

*Primary Examiner* — Mark Rosenbaum
(74) *Attorney, Agent, or Firm* — Pillsbury Winthrop Shaw Pittman LLP

(57) ABSTRACT

Disclosed herein is a shredder having a device located at least partially between a shredder mechanism and an output side of the shredder housing to disperse any accumulation of shredded materials at least adjacent the output opening, as well as remove shredded materials caught in or near the cutting assembly. One device is a movable device positioned between a shredder mechanism and the output side of the shredder housing that is configured to pivot about an axis in an oscillating manner. Another device includes a fan mechanism for blowing and moving shredded materials through a passageway in the shredder housing and towards an outlet.

59 Claims, 16 Drawing Sheets

SHREDDER WITH ROTATABLE DEVICE FOR MOVING SHREDDED MATERIALS ADJACENT THE OUTLET

CROSS-REFERENCE TO RELATED APPLICATION

This application is a continuation-in-part of U.S. patent application Ser. No. 13/089,030, filed on Apr. 18, 2011, which in turn is a continuation of U.S. patent application Ser. No. 12/314,182, filed on Dec. 5, 2008, now U.S. Pat. No. 7,942,352, issued on May 17, 2011, the entire contents of both of which are incorporated herein by reference.

BACKGROUND

1. Field

The present disclosure is generally related to shredders for destroying articles, such as documents, CDs, etc. More specifically, the present disclosure is related to shredders including a rotatable device for moving shredded materials in a shredder.

2. Description of Related Art

During operation of a shredder, paper or other articles are fed through the input opening or throat of the shredder to be destroyed. As shown in FIG. 1, when paper is fed through a throat 101 of shredder 100, the paper travels into a cutting assembly 102 where it is shredded into smaller particles. The particles then exit through an outlet 104 of housing 105, and accumulate inside waste bin 103. However, problems may develop at or near the outlet 104 of the shredder 100, which may affect proper operation of the shredder.

One problem which may develop during shredding of articles includes when shredded particles adhere to or near the cutting assembly 102 or outlet 104 of the shredder 100. Such a phenomenon of accumulated particles known as "bird nesting," as indicated by element 120. The shredded particles may accumulate due to physical or electrostatic means, for example. Over time, bird nesting particles 120 that accumulate near outlet 104 can become lodged inside the cutting assembly 102 or outlet 104 and reduce the sheet capacity (i.e., the amount of articles to be received and shredded in the cutting assembly) of the machine. Thus, extra strain may be placed on the gears, bearings, and motor (not shown) associated with the cutting assembly, and may even damage the cutting assembly 102. It is therefore desirable to reduce bird nesting particles 120 in order to extend the life and efficiency of a shredder 100 and maintain proper operation. This problem occurs more often in cross-cutting shredders, because the small chips formed by cross-cutting are more likely to accumulate.

Additionally, after articles have been shredded and particles descend from the housing 105, a second problem may develop. As shredded particles collect inside the waste bin 103, the shredded particles tend to accumulate in a shape similar to a peak or mountain, sometimes also referred to as "crowning," as indicated by element 130. An accumulation of crowing particles 130 is inefficient since the particles will quickly build up. The crowning particles 130 may then perhaps start pushing against the cutting assembly 102, possibly contributing to the accumulation of bird nesting particles 120. The crowning particles 130 may also falsely or prematurely trigger a bin full detection system before the waste bin 103 is completely full. User assistance may then be required to either empty the waste bin 103, remove shreds that have accumulated near the output opening or cutting assembly, or to even out the pile of particles by hand before continuing to shred. Such assistance may not only be time consuming, but also dangerous. It is therefore desirable for a shredder to have particles which accumulate evenly in the waste bin 103, particularly in shredders that utilize a bin full detection system.

Some prior art methods have attempted to develop devices to curb such problems. For example, U.S. Patent Application 2008/0041988 A1 describes a brush-off device that slides reciprocally along shafts (e.g., in a horizontal direction relative to the shafts) of a cutter assembly in an axial direction. However, the prior art fails to provide a feature for cleaning an underside of the cutting assembly or outlet. Rather, the prior art functions below the shredder housing.

To prevent crowning, the prior art, such as U.S. Patent Applications 2007/029542 A1 and 2007/0295736 A1, describes shredders having containers or bins that are rocked to prevent build up of particles. U.S. Pat. No. 7,150,422 B2 provides a manual device for pressing paper downwardly in the bin. However, none of the prior art devices are designed to operate inside or with the shredder housing to clear particles caught in the cutter elements of the cutter assembly, as well as assist in preventing crowning in the bin.

SUMMARY

One aspect of the disclosure provides a shredder including a shredder housing having a shredder mechanism mounted therein, the shredder housing has an input opening for receiving materials and an output opening for depositing shredded material therefrom, and the output opening being open to an output side of the shredder housing. The shredder mechanism has a motor and a cutter assembly, the motor rotating the cutter assembly to shred materials fed therein. Also a movable device is positioned at least partially between the shredder mechanism and the output side. The movable device has a shaft and one or more radially extending structures extending at least partially radially with respect to the shaft, and the shaft is configured to pivot about an axis parallel to an axis of the cutter assembly in an oscillating manner so as to move shredded materials at least adjacent to the output opening.

Another aspect provides a method for moving shredded materials in a shredder. The method includes: feeding material to be shredded into an input opening in a shredder housing of the shredder; shredding the material with a shredder mechanism mounted in the shredder housing, the shredder mechanism including a motor and a cutter assembly, the motor rotating the cutter assembly to shred materials fed therein; depositing the shredded material via an output opening in the shredder housing, the output opening being open to an output side of the shredder housing; and pivoting a shaft of a movable device about an axis that is parallel to an axis of the cutter assembly in an oscillating manner, the movable device being positioned at least partially between the shredder mechanism and the output side and the shaft of the movable device having radially extending structures associated therewith extending at least partially radially with respect to an axis of the shaft so as to move shredded materials at least adjacent to the output opening.

Another aspect provides a shredder including a shredder housing having a shredder mechanism mounted therein. The shredder housing has an input opening for receiving materials and an output opening for depositing shredded material therefrom, the output opening being open to an output side of the shredder housing. The shredder mechanism includes a motor and a cutter assembly, the motor rotating the cutter assembly to shred materials fed therein. The shredder also has a fan mechanism constructed and arranged to provide forced air towards the output opening to move the shredded material at least adjacent to the output opening.

Yet another aspect provides a method for moving shredded materials in a shredder. The method includes: feeding material to be shredded into an input opening in a shredder housing of the shredder; shredding the material with a shredder mechanism mounted in the shredder housing, the shredder mechanism including a motor and a cutter assembly, the motor rotating the cutter assembly to shred materials fed therein; depositing the shredded material via an output opening in the shredder housing, the output opening being open to an output side of the shredder housing; and outputting forced air towards the output opening using a fan mechanism so as to move the shredded material at least adjacent to the output opening.

Other objects, features, and advantages of the present disclosure will become apparent from the following detailed description, the accompanying drawings, and the appended claims.

DETAILED DESCRIPTION OF THE PREFERRED EMBODIMENT(S)

The described devices herein are designed to resolve or alleviate one or more of the above-noted problems found in conventional paper shredders; specifically, where particles accumulate unevenly in the waste bin, where shredded materials or paper particles become stuck to a bottom of the shredder housing and cutting assembly, and/or when bin full detection systems inaccurately detect a full bin due to accumulation or piling of shredded materials or the materials attached to the shredder housing.

Figure 2:
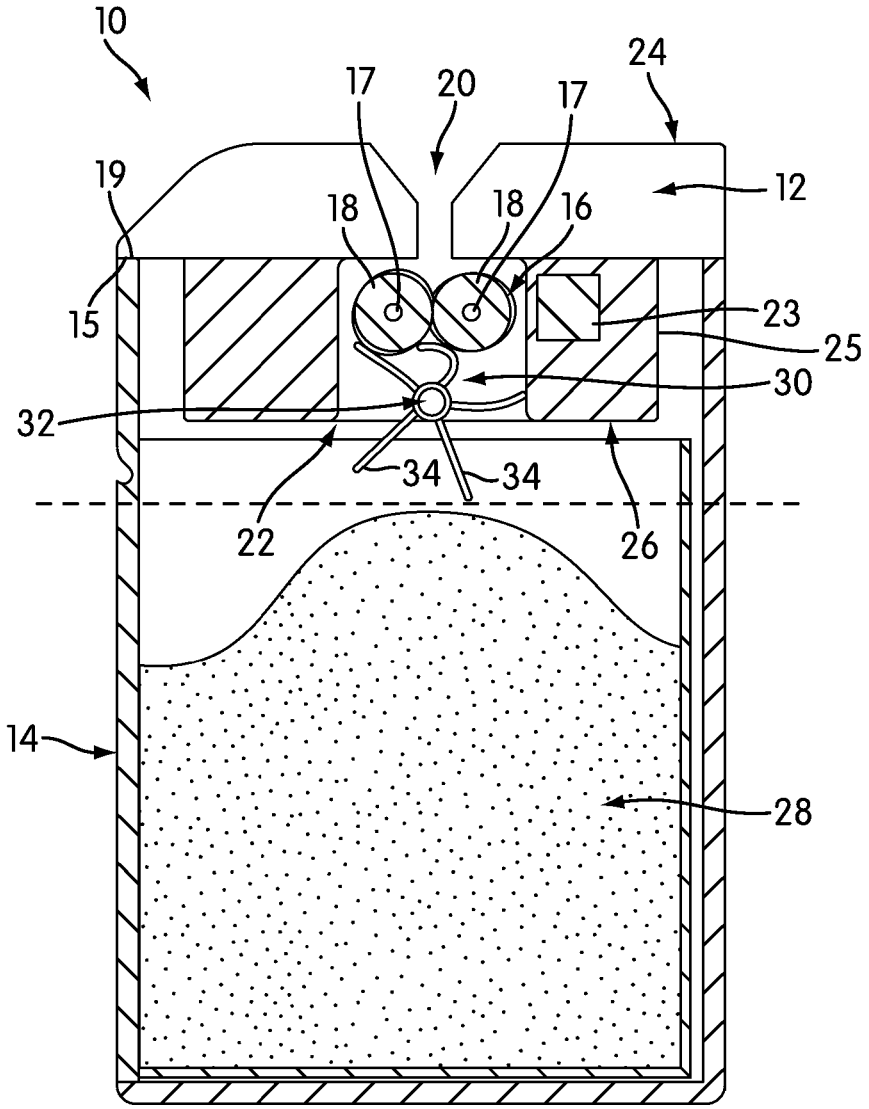
FIG. 2 is a cross-sectional view of a shredder having a rotatable device in accordance with an embodiment of the disclosure.

Referring now more particularly to the drawings, FIG. 2 is a cross-sectional view of a shredder 10 in accordance with an embodiment of the present disclosure. The shredder 10 is designed to destroy or shred articles such as paper and/or disks (e.g., CDs). In an embodiment, the shredder 10 may comprise wheels (not shown) to assist in moving the shredder 10. The shredder 10 comprises a shredder housing 12 that can sit on top of a container or bin 14, for example. The shredder housing 12 comprises at least one input opening 20 on an upper side 24 (or upper wall or top side or top wall) of the housing 12 for receiving materials to be shredded. The input opening 20 may generally extend in a lateral direction, and is also often referred to as a throat. The input opening 20 or throat may extend generally parallel to and above a shredder mechanism 16 (described below). The input opening or throat 20 may be relatively narrow, so as to prevent overly thick items, such as large stacks of documents, from being fed therein. However, throat 20 may have any configuration. In an embodiment, an additional or second input opening (not shown) may be provided in shredder housing 12. For example, throat 20 may be provided to receive paper, paper products, and other items, while second input opening (not shown) may be provided to receive objects such as CDs and DVDs.

Shredder housing 12 also comprises an output opening 22 or outlet on an output side 26 (or lower side or bottom side or bottom wall or underside or bin side). Output side 26 may be a lower side of shredder housing 12 (as generally shown in the illustrated embodiments) but it should be understood that the illustrated embodiments are not intended to be limiting in any way, and that output side 26 refers to a side in which shredded material(s) are deposited from the shredder mechanism 16. In an embodiment, shredder housing 12 may include a bottom receptacle 25 to receive shredder mechanism 16 therein. Bottom receptacle 25 may include output opening or outlet 22 in its output (lower) side 26 through which shredded material is deposited into the bin 14. The bottom receptacle 25 and/or outlet 22 may reside within the opening of the bin 14 so as to direct shredded particles into the bin. Generally speaking, the shredder 10 may have any suitable construction or configuration and the illustrated embodiments provided herein are not intended to be limiting in any way.

As noted, the shredder 10 also comprises a shredder mechanism 16 in the housing 12. When articles are inserted into the at least one input opening or throat 20, they are directed toward and into shredder mechanism 16. "Shredder mechanism" is a generic structural term to denote a device that destroys articles using at least one cutter element. Destroying may be done in any particular way. Shredder mechanism 16 includes a drive system with at least one motor 23, such as an electrically powered motor, and a cutter assembly comprising at least plurality of cutter elements 18. The cutter elements 18 of cutter assembly are mounted on a pair of parallel mounting shafts 17. Typically, the cutter elements will be designed for cross-cutting (i.e., for shredding the article into small chips). See, e.g., U.S. Pat. No. 6,260,780 to Kroger et al., the entirety of which is incorporated herein by reference. However, other cutter elements may be used. Strippers may also be provided in the cutter assembly and in any number of configurations.

The motor 23 operates using electrical power to rotatably drive the mounting shafts 17 of the shredder mechanism 16 and their corresponding cutter elements 18 through a conventional transmission (not shown) so that the cutter elements 18 shred or destroy articles fed therein, and, subsequently, deposit the shredded materials into bin 14 via the outlet 22. The shafts 17 are mounted in relation to the throat and may be provided on lateral axes A1 and A2, respectively. The shafts 17 are configured to rotate about axes A1 and A2 so as to rotate the cutter elements 18 of the cutter assembly for shredding. In an embodiment, the shredder mechanism 16 may also include a sub-frame for mounting the shafts, motor, and transmission. The drive system may have any number of motors and may include one or more transmissions. Also, the plurality of cutter elements 18 are mounted on the rotatable mounting shafts 17 in any suitable manner. For example, in an embodiment, cutter elements 18 are rotated about axes A1 and A2 in an interleaving relationship for shredded paper sheets or other articles fed therein. In an embodiment, the cutter elements 18 may be provided in a stacked relationship. The operation and construction of such a shredder mechanism 16 is well known and need not be discussed herein in detail. As such, the at least one input opening or throat 20 is configured to receive materials inserted therein to feed such materials through the shredder mechanism 16 and to deposit or eject the shredded materials through output opening or outlet 22.

The bin 14 receives shredded materials or articles from the shredder mechanism 16 of the shredder 10. The bin 14 comprises a bottom wall, four side walls, and a top, for example. Generally, the shredder housing 12 is configured to be seated above or upon the container 18. Shredder housing 12 may comprise a detachable paper shredder mechanism, as shown in FIG. 2. That is, in an embodiment, the shredder housing may be moved or removed in relation to the container or bin 14 to ease or assist in emptying the bin 14 of shredded materials. In an embodiment, shredder housing 12 comprises a lip 15 or other structural arrangement that corresponds in size and shape with a top edge 19 or opening of bin 14. After inserting materials into throat 20 for shredding by cutter elements 18, the shredded materials are deposited from output opening or outlet 22 on the output (lower) side 26 of the housing 12 into the opening of the bin 14. The bin 14 may be a waste bin, for example. In some embodiments, the bin 14 may be positioned in a frame or secondary housing beneath the shredder housing 12. For example, the frame may be used to support the shredder housing 12 as well as comprise a container receiving space so that the container or bin 14 may be removed therefrom. Generally the terms "container," "waste bin," and "bin" are defined as devices for receiving shredded materials discharged from the output opening 22 of the shredder, and such terms are used interchangeably through this specification. However, such terms should not be limiting. Bin 14 may have any suitable construction or configuration.

Though not shown, a power supply to the shredder may be in the form of a standard power cord with a plug on its ends that plugs into a standard AC outlet. Generally, the use of a control panel is known in the art. For example, the upper side 24 of housing 12 may also include a power switch or plurality of switches and/or switch recess or an on/off switch. Any number of switches may be provided. A switch may be moved so as to move a switch module between states (e.g., ON, OFF), for example. For example, the switch module may communicate with a controller and a motor 23 to send (or stop) transmission of electrical signals for rotating the cutter elements 18 of the shredder mechanism 16 in a shredding direction. The switch module may also communicate so as to operate the motor 23 in a reversing manner to move the cutter elements 18 in a reversing direction, such as when there is a need to clear jams, for example. Generally, the construction and operation of switches and controllers for controlling the motor are well known and any construction for these may be used. For example, a touch screen switch, a membrane switch, and a toggle switch are each types of switches that may be used. Also, the switch may have any number of states or signals (e.g., lights, display screen) associated therewith.

As shredder 10 is used, shredded materials (e.g., paper) are deposited/directed into bin 14. As shown in FIG. 2, as shredded materials fill the bin 14, they may form a pile 28. Also, shredded materials may accumulate near or adjacent the outlet 22 or the output (lower) side 26 of the shredder housing 12. Shredder 10 comprises a rotatable device 30 to assist in reducing such issues. More specifically, a rotatable device 30 is provided or mounted on the output (lower) side 26 of the shredder housing 12 to assist in moving shredded materials caught in or around the cutting assembly. Rotatable device 30 is positioned adjacent the output opening or outlet 22, as shown in FIG. 2. The rotatable device 30 is configured to move shredded materials positioned adjacent the output opening 22, as will be further described below. In some embodiments, the rotatable device 30 extends at least partially into the bin 14, so as to move shredded materials which accumulate into a pile 28 in the bin 14.

Figure 3:
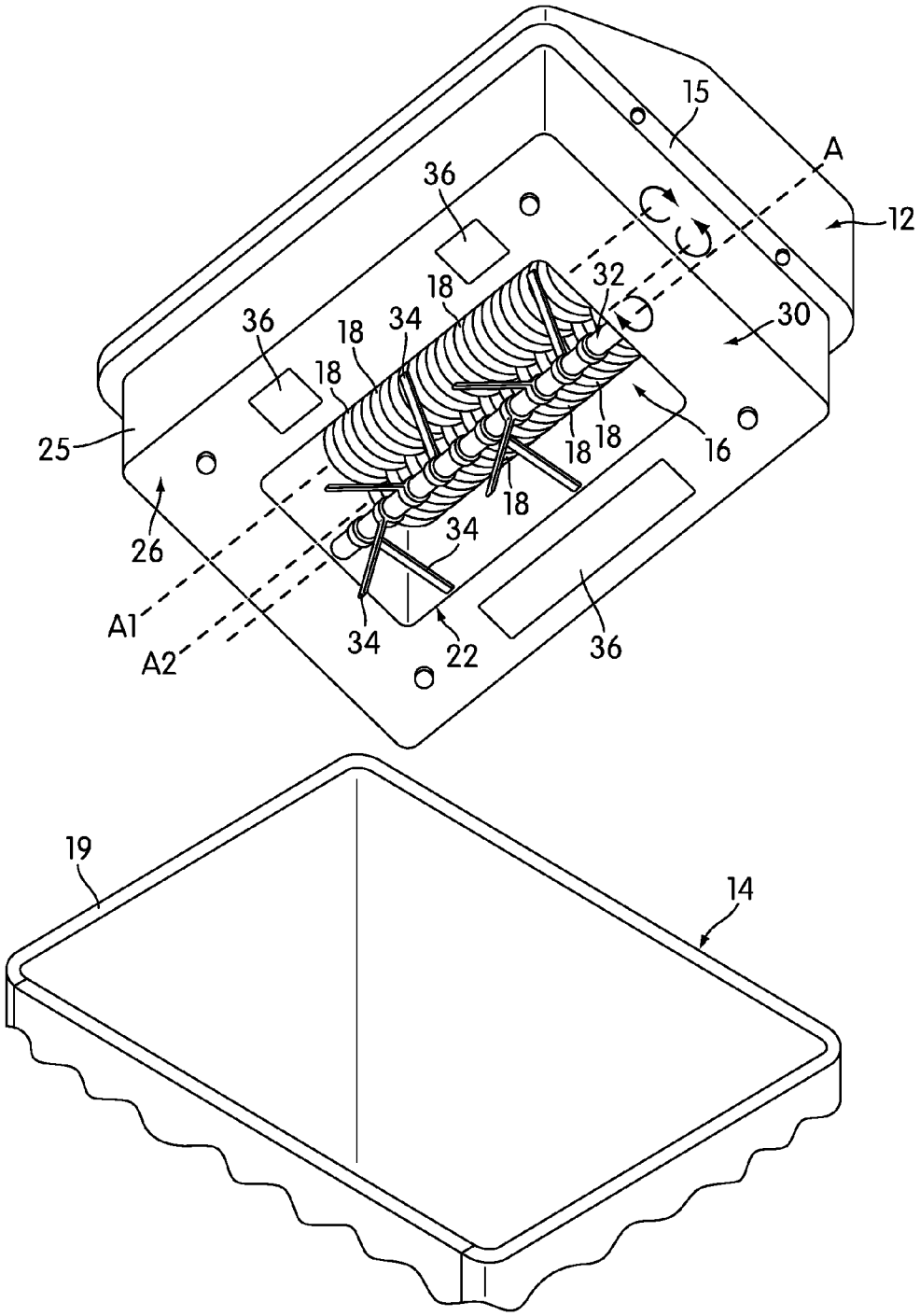
FIG. 3 is a perspective view of a lower side of a shredder housing of the shredder of FIG. 2 illustrating the rotatable device in accordance with an embodiment of the disclosure.

The rotatable device 30 comprises an auxiliary shaft 32 configured to rotate about a parallel, lateral axis A adjacent the axes A1 and A2 of the cutter elements 18 of the cutter assembly. In some embodiments, the rotating shaft 32 of the rotatable device 30 may be positioned below the shredder mechanism 16, as illustrated in FIG. 3. In some embodiments, the shaft 32 is mounted within the shredder housing 12 or, alternatively, within the shredder mechanism 16. The shaft 32 may be rotated in any direction, e.g., in a clockwise direction or a counterclockwise direction. In some embodiments, the shaft 32 of the rotatable device 30 is driven by the motor 23 rotating the cutter elements 18 of the cutting assembly. In some embodiments, the shaft 32 of the rotatable device 30 is rotated by a separate motor (not shown).

As shown in greater detail in FIG. 3, the rotatable device may comprise a plurality of fingers 34 projecting from a surface 33 of shaft 32 in a perpendicular direction in relation to the parallel axis A (i.e., in a radial direction). "Fingers" as provided herein are defined elongated structures that generally extend or stand radially in relation to the shaft 32. The fingers 34 are provided to assist in moving shredded materials adjacent the outlet 22, such as shredded materials that may nest near walls of or output (lower) side 26 of the outlet 22, or even near or between cutter elements 18. In some embodiments, the fingers 34 are structures that are flexible or resilient. For example, a single bendable or resilient finger may be provided. Here, a plurality of fingers 34 is provided on rotatable device 30. In some embodiments, the fingers 34 are fixed in position on the shaft so as to rotate with the shaft 32. Thus, when the shaft 32 is activated or rotated about axis A, the fingers 34 rotate about axis A. In other embodiments, the fingers are associated with the shaft, and are not necessarily directly connected to the shaft; however, movement of the shaft can be configured to move the fingers.

The terms "radial" or "perpendicular" when used with respect to the fingers are not to be taken as requiring a perfect or true radial or perpendicular direction. Instead, having a perpendicular or radial extent or vector sufficient to project the fingers from the shaft for performing their function is within the meanings of these terms. Likewise, the fingers need not be straight and may have curved or other shapes.

Generally, the fingers 34 comprise an elongate shape that is capable of at least partially extending into the bin 14 as well as into the shredder mechanism 16 or the cutter elements 18. In some embodiments, the fingers 34 are provided about the shaft 32 such that they extend in a number of different directions or angles. In some embodiments, the fingers may be formed or added to the shaft 32 in a helical manner. In some embodiments, the plurality of fingers 34 comprises bristles which are fixed in position on the shaft so as to rotate with the shaft. In some cases, a plurality of fingers may be referred to as bristles or a brush, and therefore the term "fingers" should not be limiting. Fingers 34 may be made from any number of resilient materials, such as elastic or rubber, for example. In some embodiments, the fingers 34 or bristles may be made from a synthetic nylon or similar material.

Figure 5:
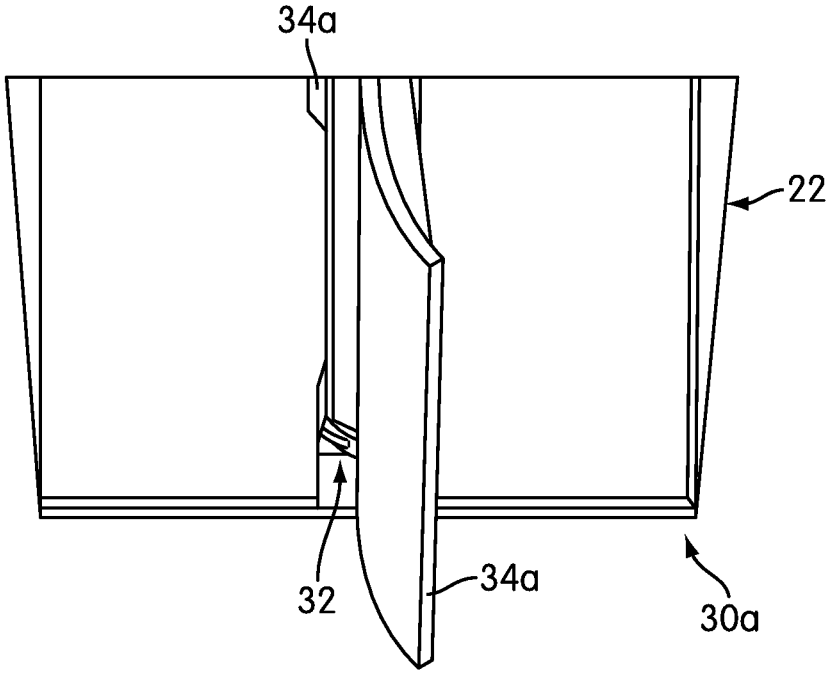
FIG. 5 is a bottom perspective view of an outlet opening on a lower side of a shredder housing of a shredder illustrate a rotatable device in an open position accordance with an embodiment of the disclosure.
Figure 6:
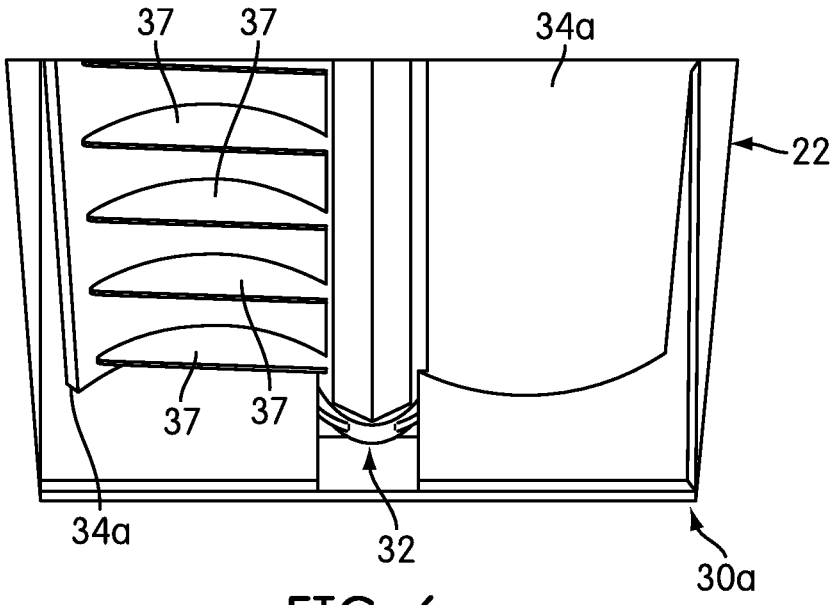
FIG. 6 is a bottom perspective view of the rotatable device of FIG. 5 in a closed position accordance with an embodiment of the disclosure.

As shown in FIGS. 5 and 6, it is envisioned in some embodiments that the rotatable device 30 may include larger or wider devices such as fins 34*a* or paddles, for example, in place of alternating fingers or bristles, acting as a brush or device for moving shredded particles adjacent the outlet 22. Fins 34*a* have a generally curved or rounded shape; however, the shape of the fins 34*a* should not be limiting. For example, fins 34*a* may comprise an elongate shape that extends at least partially along the axis A of the shaft 32 of the rotatable device 30. In some embodiments, two or more fins 34*a* may be provided to rotate about the shaft 32. As shown in FIG. 6, two fins 34*a* are attached or formed along axis A of the rotatable device 30 and extend from the shaft 32. The fins 34*a* may comprise a width that is substantially similar to a length of the shaft (e.g., a length along the axis). The fins 34*a* may also comprise a length that is substantially similar to an inside dimension of the outlet 22 or bottom receptacle 25. In some cases, the length of the fins 34*s* allows it to extend such that it is still able to rotate into at least a part of the outlet 22 and extend at least partially into the bin 14. FIGS. 9A-12, described further below, show another embodiment of fins for a rotatable device. In any case, the fins 34*a* are designed such that they are able to move shredded particles adjacent the outlet 22.

In an embodiment, fins 34*a* may comprise additional devices or vanes 37, which may be formed during manufacture and/or provide additional stability to the rotatable device 30. Fins 34*a* may also be made from any number of materials. For example, fins 34*a* may be formed from an elastic or rubber material, or from a substantially rigid material, such as plastic. Should the fins 34*a* have some flexibility or resiliency, vanes 37 may assist in providing some structural stability about its length and width.

Besides assisting in moving shredded material adjacent the outlet 22, fins 34*a* also assist in reducing shredded materials from falling out of the outlet 22 during emptying. More specifically, the fins 34*a* of the rotatable device may be oriented in a closed position to substantially prevent shredded materials from being discharged from the outlet by "closing" the outlet 22 when the shredder housing 12 and bin 14 are moved out of an operative position relative to each other. When waste bins 14 or containers are typically emptied, the cutting elements 18 of shredder mechanism 16 may have shredded materials (e.g., particles of waste or trash) caught therein (e.g., which may cause bird nesting). Thus, when the bin 14 is moved, the shredder mechanism 16 may be agitated and the particles originally stuck in the cutting elements 18 may become dislodged and fall into a housing of an outer frame and/or the area surrounding the shredder 10 (e.g., the floor). Users or consumers using shredders having a pull out waste bin in particular do not expect this type of mess and difficulty when emptying the bin. In particular, users do not want waste particles falling when the bin is not in a position to catch them (i.e., when the bin 14 is not under the shredder housing 12). However, the fins 34*a* may address this type of annoying waste particle mess problem by preventing the shredded materials (waste) in or adjacent the shredder mechanism 16 from being discharged from the outlet 22 during a waste bin emptying process.

Figure 7:
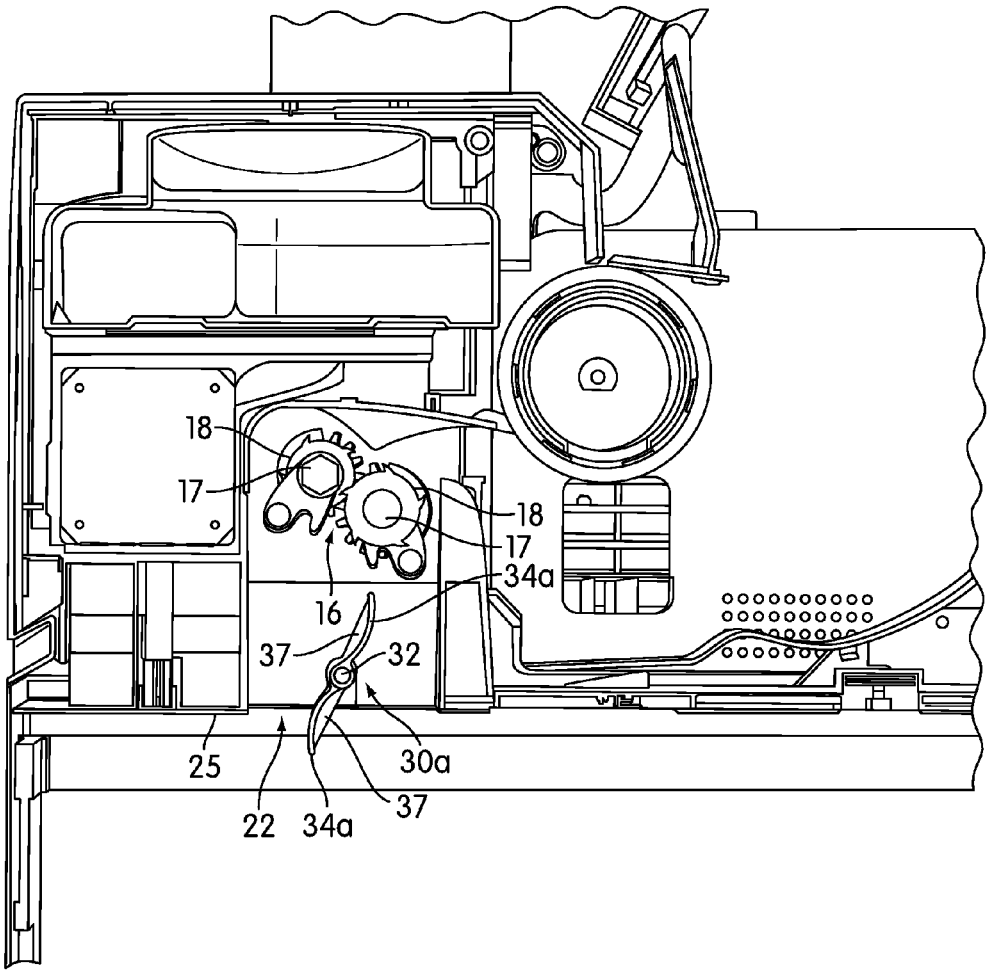
FIGS. 7 and 8 show cross-sectional side views of an inside of a shredder housing of a shredder having the rotatable device of FIGS. 5 and 6, respectively.
Figure 8:
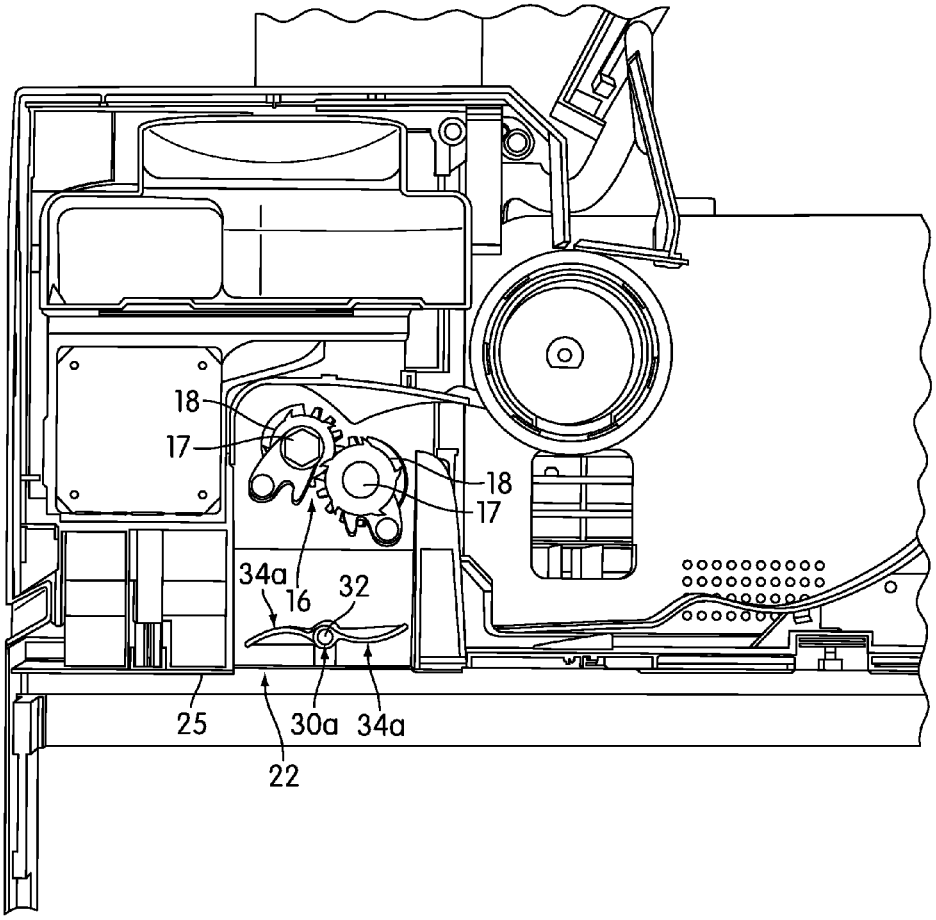

Specifically, the fins 34*a* of the rotatable device 30 may be positioned in relation to the outlet 22 such that they are in an open position or a closed position. FIGS. 7 and 8 show cross-sectional side views of an inside of a shredder housing of a shredder having a rotatable device 30 with fins 34 in open and closed positions, respectively. An open position is defined as a first position wherein the fins 34*a* are positioned in the outlet 22 or bottom receptacle 25 without substantially blocking shredded materials from being discharged therefrom, i.e., allowing shredded materials to be deposited into the container or waste bin, such as shown in FIGS. 5 and 7. A closed position is defined as a second position wherein the fins 34*a* are positioned such that they are substantially covering the outlet 22 of the shredder housing 12 to prevent shredded materials from being discharged therefrom, such as shown in FIGS. 6 and 8 (e.g., across the outlet). As an option, the fins may extend for the entire or substantially the entire length of the outlet so that particles do not escape between individual fingers. Additional description regarding activation and positioning of the rotatable device 30 is provided below.

Also, by moving the fins 34*a* into a closed position in the outlet 22 as shown in FIG. 8, damage to the fins 34*a* (e.g., from the user hitting the fins 34*a* with an edge of the bin 14) is also prevented. Further, it should be noted that, for illustrative purposes only, the fins 34*a* of the device 30 as shown in FIGS. 7 and 8 do not extend between the cutter elements 18. However, it is envisioned that the width of the fins 34*a* may be formed such that at least an edge or a series of individual projections of the fin 34*a* substantially contacts or intrudes between the cutter elements 18 in an embodiment.

The rotation of the rotatable device 30 may be activated in any number of ways. In some embodiments, the rotation may be activated manually. For example, a switch may be provided which triggers a motor to start rotation of the rotatable device 30. In some embodiments, the rotation of the rotatable device 30 may be activated automatically. In this case, "automatically" activating rotation refers turning or rotating the shaft 32 of the device 30 at the time or detection of a predetermined event or occurrence. For example, the rotation may be associated with the activation of the shredder mechanism 16. The rotatable device 30 may also be activated to rotate concurrently with the cutter elements 18 of the cutting assembly (e.g., such as when motor 23 is used to rotate both the shredder mechanism 16 and the rotatable device 30). In some embodiments, the rotation of the rotatable device 30 is associated with a power switch for turning on the shredder 10. As an option, a positional sensor, such as a Hall sensor, may be used to detect and control the rotational position of the device 30.

In some embodiments, the rotation of the rotatable device 30 may be associated with one or more sensing devices 36 of the shredder 10, such as "bin full" sensors. The shredder 10 may comprise at least one sensor 36 to detect a presence of shredded materials in relation to the rotatable device 30, or in relation to the shredder housing 12 and/or mechanism 16. The sensor(s) 36 may be provided on the output (lower) side 26 of the shredder housing 12 as shown in FIG. 3. Additionally or alternatively, the sensor(s) may be provided on a side of the bin 14 or in a manner so as to detect an accumulation of shredded materials or particles within the walls of the bin 14. In some embodiments, one or more sensor(s) 36 may be provided to activate the rotation of the shaft 32 of the rotatable device 30 upon the detection of the presence of shredded materials. In some embodiments, one or more sensor(s) 36 may communicate with a controller to activate the rotatable device 30 upon reaching or exceeding a predetermined threshold. For example, one such threshold may be upon detection of a level of the shredded materials, e.g., when the bin 14 is detected as full, or detects the accumulation of shredded particles in a pile 28. The rotatable device 30 may be activated when shredded materials or particles have accumulated to a predetermined capacity (e.g., of 90 percent full), or when the shredded materials appear to be within a predetermined distance below the output (lower) side 26 of the housing 12 (e.g., 2 to 3 inches from the housing 12).

In some embodiments, the rotatable device 30 may also be implemented in conjunction with a plurality of bin full detectors such as sensors 36 to rotate in a specific direction based on the level of shredded material detected in the waste bin 14. In such an implementation, the plurality of sensors 36 may be positioned on the output (lower) side 26 of the shredder housing 12 so as to detect characteristics associated with the pile 28 of shredded materials. For example, the sensors 36 may assist in determining a slope of the pile 28 or its highest position of accumulation. The device 30 may then be activated to rotate in such a way so as to move the shreds from the peak of the pile 28, to either toward a front or back or left or right side(s) of the bin 14 of the shredder 10, depending on the accumulation characteristics in the bin 14. Thus, the rotatable device 30 may more efficiently distribute the shredded material inside the bin 14.

In some embodiments, such as when the shaft 32 is rotated by a separate motor, a rotary sensing device may be associated with the rotatable device 30. Such a rotary sensing device may be used to verify that the device 30 rotates to a predetermined position (e.g., a horizontal position). For example, as shown in FIGS. 7 and 8, the rotatable device 30 may be rotated to a stop such that its fins 34*a* are provided in a specific position. Generally, the fins 34*a* of the rotatable device 30 are designed to rotate when activated and be in a substantially open position when the shredder 10 is enabled and in an operative position ready for use. However, the rotatable device 30 may be rotated by a separate motor and stopped such that the fins 34*a* are in a substantially closed position when the shredder power is off and/or when it is detected that the bin 14 is being moved relative to the shredder housing 12. That is, when the bin 14 is pulled away from the shredder housing or outwardly from a frame (i.e., out of an operative position relative to the shredder housing 12), the fins 34*a* are stopped when in a horizontal direction, so that they could catch any shredded particles that may fall from the cutter elements 18. Thus, the rotary sensing device would detect whether the fins 34*a* are positioned correctly to stop shredded materials.

Figure 4:
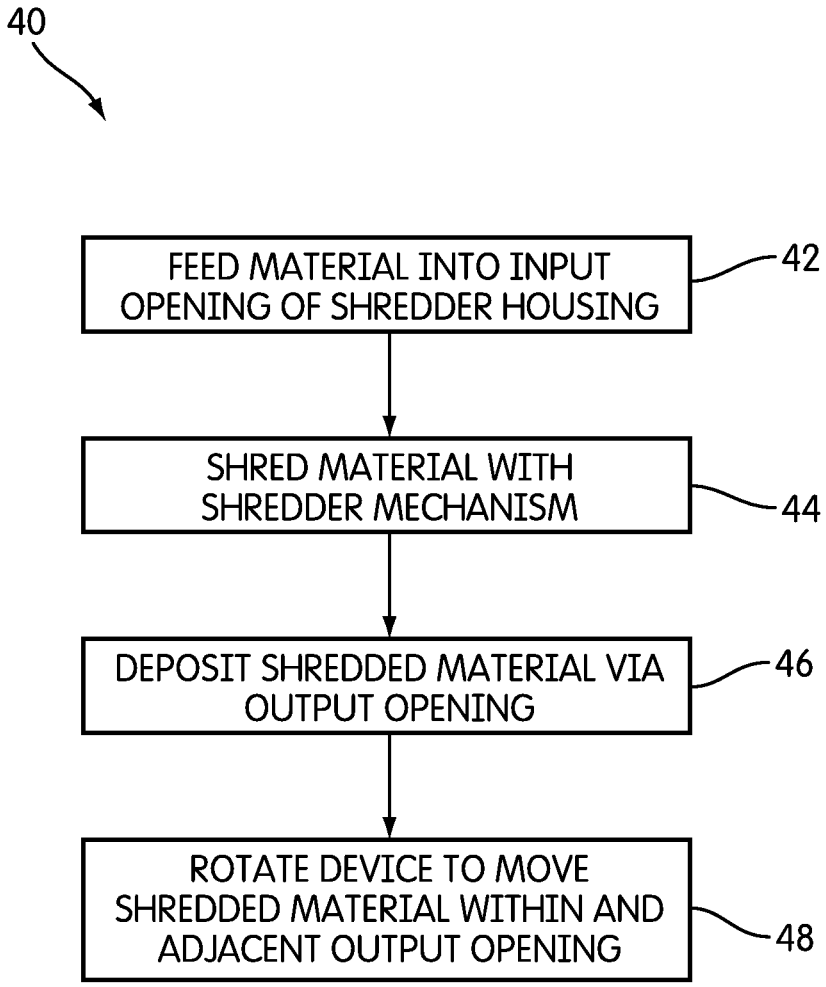
FIG. 4 is a flow chart diagram illustrating a method for moving shredded materials in a shredder in accordance with an embodiment of the disclosure.

FIG. 4 provides a flow chart diagram illustrating a method 40 for moving shredded materials in a shredder 10 in accordance with an embodiment of the present disclosure. Step 42 provides feeding material into an input opening or throat 22 of the shredder housing 12. The material is then shredded using the shredder mechanism, e.g., shredder mechanism 16, indicated at step 44. As the shredded material is deposited via the output opening or outlet 22 (and into bin 14), as indicated at step 46, the rotatable device is rotated, at step 48, to move shredded material positioned within and adjacent the output opening 22. Material positioned within and adjacent the output opening or outlet 22 may be material near the opening 22, such as bird nested particles 120, or material that has accumulated in a pile 28 adjacent the outlet 22 and/or in bin 14, for example. Material positioned within and adjacent the output opening 22 may also include shredded or partially shredded materials or particles that are in the shredder mechanism 16 or cutter elements 18.

Figure 1:
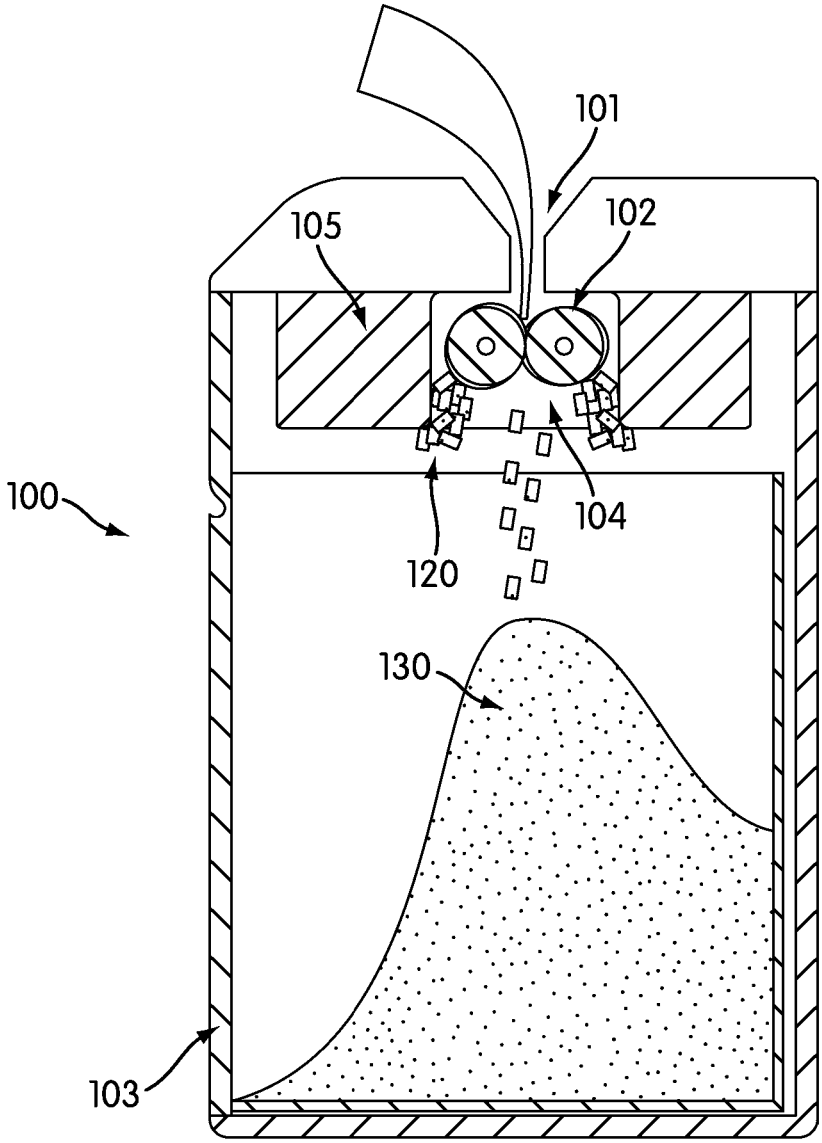
FIG. 1 PRIOR ART
FIG. 1 is a cross-sectional view of a shredder of the prior art.

The rotatable device 30 is designed to alleviate both bird-nesting 120 and crowning 130 problems in shredders, as discussed with reference to FIG. 1 above. As the fingers 34 of the rotatable device 30 are rotated below the shredder mechanism 16, they perform multiple functions. For example, the resiliency or flexibility of the fingers 34 enables them to enter between cutter elements 18 (see FIG. 2) and dislodge any shredded material (e.g., paper particles) caught in or around the cutting assembly. This effectively dislodges any bird-nesting particles from between the cutter elements 18 and around the shredder mechanism 16 and outlet 22 to increase smooth shredding operation. It also assists in reducing or eliminating false bin full alerts detected by one or more sensors.

In addition, as the fingers 34 are rotated they also engage and disperse shredded materials entering or accumulating in the bin 14. Thus, the rotating device may act as a raking device, so that a pile 28 may be leveled and a more even pile may be formed in the bin 14. This allows the bin 14 to more effectively fill to capacity, as well as reduce premature bin full alerts detected by sensors, that may require user attention.

It should be noted that the position of the rotatable device 30 (or its rotating shaft 32) below the shredder mechanism 16 contributes to providing the above-noted benefits. The rotatable device 30 is able to perform two functions using a single device. Additionally, the rotatable device 30 as described herein rotates in a circular motion, rather than a reciprocal motion relative to the shafts (e.g., in a horizontal direction) as provided in the prior art. This is advantageous because the rotatable device 30 is able to assist in cleaning shredded materials from the underside of the shredder mechanism 16 and/or cutting assembly, as well as near the output (lower) side 26 of the shredder housing 12 (e.g., such as in the bin 14). Moreover, the rotating shaft design improves upon horizontal reciprocal or sliding shaft designs because it reduces the risk of device or its bristles from becoming jammed by stray particles, and possibly malfunctioning.

Also, the positioning of the fingers 34 from the surface 33 of the shaft 32 should not be limited. In some embodiments, the fingers 34 may be designed to extend from the shaft 32 in a diagonal or angled relationship with respect to axis A. The design or shape of the fingers 34 also should not be limiting. For example, the fingers or bristles may be designed in any manner such that they are able to at least partially extend into the bin as well as into the shredder mechanism 16. The fingers may have a rounded, angled, polygonal, or elongate shape. Also, the fingers 34 may be added to shaft 32 or manufactured with shaft 32 so as to form a uniform assembly. Alternatively, as previously noted, other shaped devices, such as paddles or elongated shapes, and other configurations, such as extending along or around the shaft 32, may be used and are not beyond the scope of this disclosure.

Figure 9A:
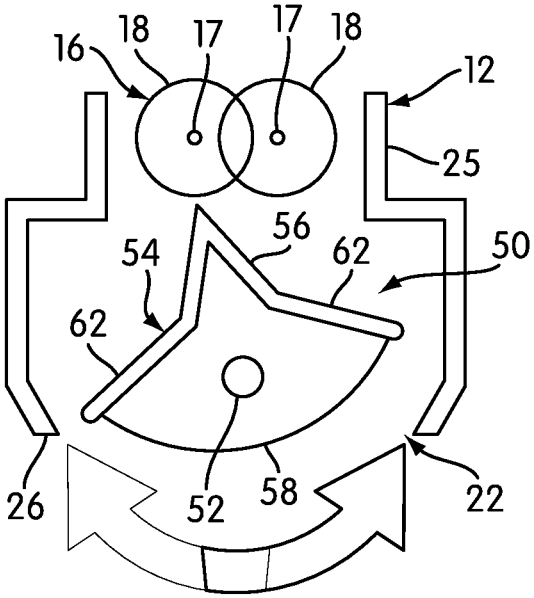
FIGS. 9A and 9B are cross-sectional side views of a shredder housing of a shredder having a movable device in accordance with another embodiment of the disclosure.
Figure 9B:
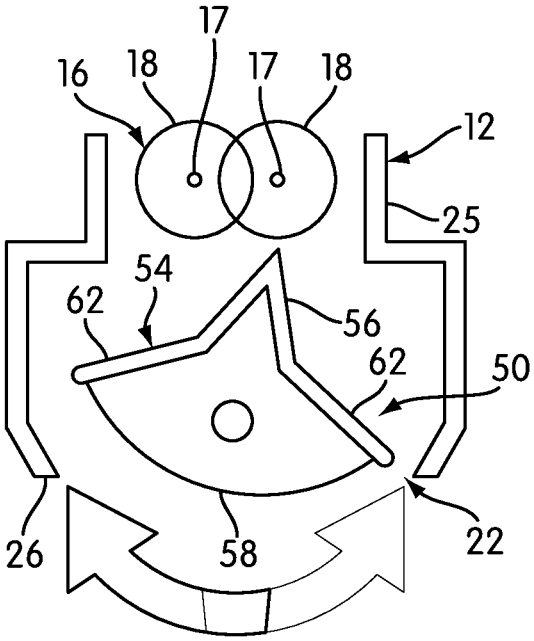

FIGS. 9A and 9B show a schematic, cross-sectional view of a movable device 50 in accordance with another embodiment of the disclosure. Movable device 50 is provided in a shredder housing of a shredder, such as shredder 10. FIGS. 9A and 9B have some similar features as previously described, and therefore similar reference numerals have been used. For example, FIGS. 9A and 9B show shredder mechanism 16 in shredder housing 12 that includes a drive system with at least one motor 23, such as an electrically powered motor, and a cutter assembly comprising a plurality of cutter elements 18. The cutter elements 18 of cutter assembly are mounted on a pair of parallel mounting shafts 17. Shredder housing 12 also comprises an output opening 22 or outlet on an output side 26 (or lower side or bottom side or bottom wall or underside or bin side or output side). In the illustrated embodiment, shredder housing 12 may include a bottom receptacle 25 to receive shredder mechanism 16 therein. Bottom receptacle 25 may include output opening or outlet 22 in its lower side 26 through which shredded material is deposited into the bin 14. The bottom receptacle 25 and/or outlet 22 may reside within or adjacent the opening of the bin 14 so as to direct shredded particles into the bin. As further described below, bottom receptacle 25 may comprise a unitary structure or several parts, including a frame member or members connected together. Generally speaking, the shredder 10 may have any suitable construction or configuration and the illustrated embodiments provided herein are not intended to be limiting in any way.

Movable device 50 is provided within shredder 10 to assist in reducing such issues as crowning, piling, and bird nesting, discussed above. More specifically, movable device 50 is provided or mounted on the output side 26 of the shredder housing 12 to assist in moving shredded materials caught in or around the cutting assembly and in bottom receptacle 25. Movable device 50 is positioned at least partially between the shredder mechanism 16 and the output side 26. Movable device 50 may be positioned adjacent the output opening or outlet 22, and/or adjacent an output of the shredder mechanism 16. The movable device 50 is configured to move shredded material positioned at least adjacent to at least the output opening 22 on output side 26 of shredder housing 12, as will be further described below. In an embodiment, movable device 50 can move shredded material positioned within and adjacent output opening 22. Movable device 50 can also move materials from the cutter assembly and/or in between cutter elements.

Figure 10:
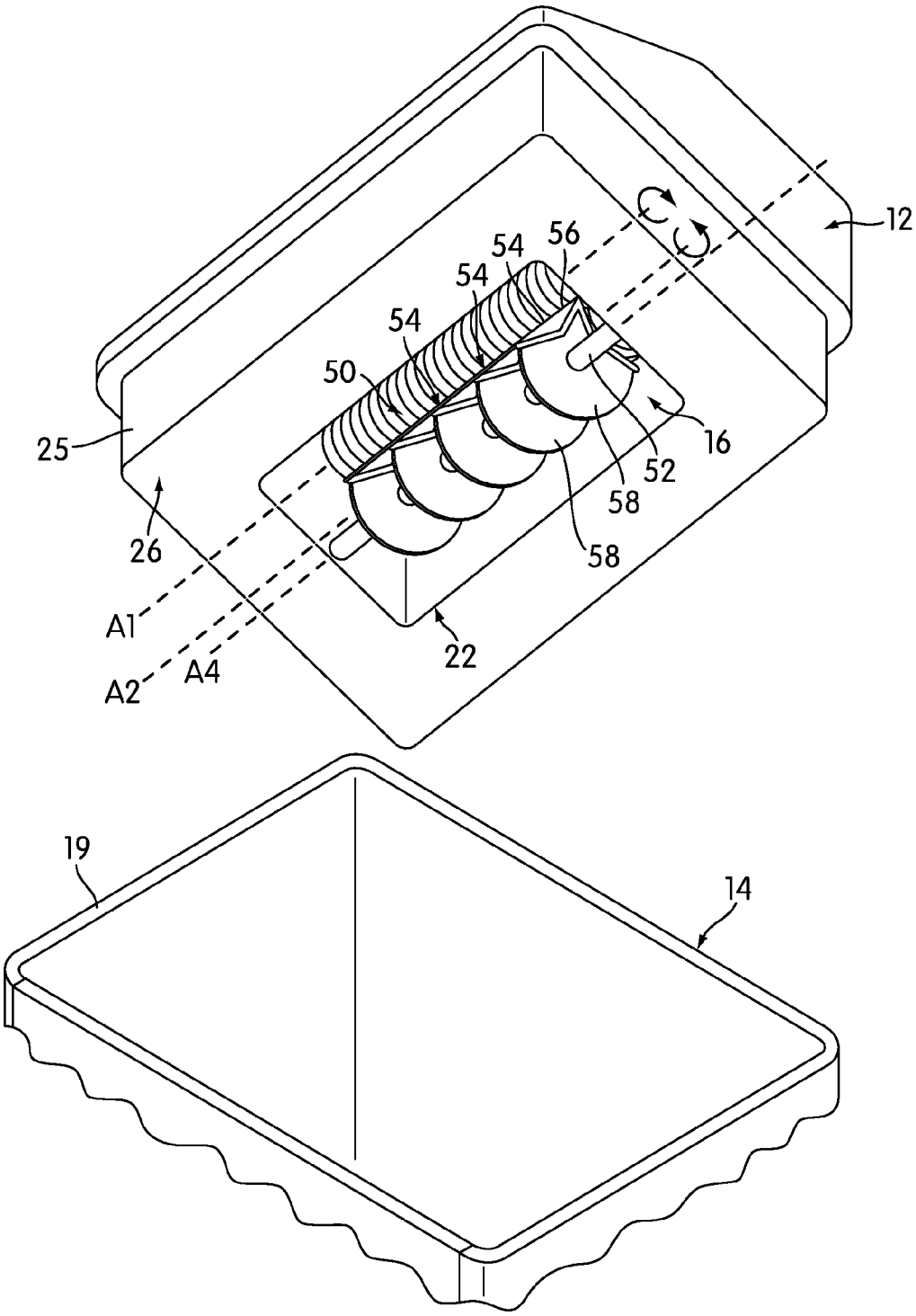
FIG. 10 is a perspective view of a lower side of a shredder housing with the movable device of FIGS. 9A-9B.

The movable device 50 comprises an auxiliary shaft 52 configured to rotate or pivot about a parallel, lateral axis A4 adjacent the axes A1 and A2 of the cutter elements 18 of the cutter assembly. In some embodiments, the shaft 52 of the movable device 50 may be positioned below the shredder mechanism 16, as illustrated in FIG. 10. In some embodiments, the shaft 52 is mounted within the shredder housing 12 or, alternatively, within the shredder mechanism 16. The shaft 52 is configured to rotate or pivot about axis A4 in any direction in an oscillating manner, e.g., in a clockwise direction and/or a counterclockwise direction, as well as alternate between each direction. In some embodiments, the shaft 52 of the movable device 50 is driven by the motor 23 rotating the cutter elements 18 of the cutting assembly. In some embodiments, the shaft 52 of the movable device 50 is rotated or pivoted by a separate motor (not shown).

Movable device 50 may comprise rotatable structures comprising structures 54 and 56 extending at least partially radially with respect to the shaft 52 in a perpendicular direction in relation to the parallel axis A (i.e., in a radial direction). The radially extending structures 54 and 56 may be connected to each other and comprise a variety of shapes. In an embodiment, the structures 54 and 56 are connected to and extend radially with respect to a surface of the shaft 52. In one embodiment, radially extending structures 54 and 56 are integrally formed on the shaft 52. In the non-limiting illustrated embodiment of FIGS. 9A and 9B, the movable device 50 comprises a shape similar to that of a letter "A." For example, radially extending structure 56 comprises two surfaces that connect to form an edge or point that extends (upwardly) towards the shredder mechanism 16 (forming a top of the letter "A"), and radially extending structure 54 extends (diagonally or downwardly) towards the output side 26/outlet 22 (forming the base or legs of the letter "A"). More specifically, radially extending structure 56 extends into the shredder mechanism 16 and cutter assembly so as to move shredded materials caught in or around the shredder mechanism 16 and cutter assembly. The (downwardly) radially extending structure 54 is connected to the (upwardly) radially extending structure 56 and comprises a blocking element 58 having at least one angled deflection surface 62 to guide and redirect shredded materials deposited from the output of shredder mechanism 16 towards the outlet 22. The blocking element 58 extends towards and in some cases into and/or through the outlet 22. In FIGS. 9A and 9B, two angled deflection surfaces 62 (on a top side) of the blocking element 58 connect to the two surfaces of the radially extending structure 56 (forming deflection areas on either side). Thus, shredded materials from the output of the shredder mechanism 16 (falling from or moved out from between cutter elements 17) are guided down a surface of the radially extending structure 56 and along an angled deflection surface 62 of the blocking element 58 of radially extending structure 54. As the movable device 50 pivots back and forth on its shaft 52 along its axis A4, shredded materials fall from at least the angled deflection surface 62, around the blocking element 58 of the radially extending structure 54, and out of the outlet path in the bottom receptacle 25 of shredder housing 1, towards and/or through the outlet 22.

Of course, it should be understood that the illustrated letter "A" shape of movable device 50 is not meant to be limiting. For example, in embodiments, movable device 50 may include one or more structures extending radially from its shaft and/or angled to form deflection surfaces in the shape of a letter "J," a letter "S," or a letter "Z."

Accordingly, although FIGS. 9A-9B and 10 illustrate a singular rotatable structure, it should be understood that movable device 50 may comprise more than one singular rotatable structure. In an embodiment, movable device 50 may comprise a plurality of rotatable structures mounted in a row along the shaft 52. For example, two or more rotatable structures, each having radially extending structures 54 and/or 56 may be spaced relative to each other and mounted along a length of shaft 52. A space between two relative rotatable structures may allow shredded particles to fall between the structures. In one embodiment, the two or more rotatable structures may be positioned at an angle on shaft 52 such that the position of each structure 54, 56 is provided to radially extend in different (alternating) direction from shaft 52. For example, a first rotatable structure may be positioned such that it is rotated relative to shaft 52 approximately 10 degrees to approximately 20 degrees towards the left (counterclockwise) from a position as shown in FIG. 9A, while a second rotatable structure may be positioned such that it is rotated relative to shaft 52 approximately 10 degrees to approximately 20 degrees towards the right (clockwise) from a position as shown in FIG. 9A. In yet another embodiment, movable device 50 may comprise a plurality of rotatable structures mounted on two separate rotating shafts on two parallel axes (e.g., axis A4 and another parallel axis (not shown)). In one embodiment, the rotatable structures may be staggered relative to each other along the shaft and/or above (or below) each other. In yet another embodiment, the rotatable structures of moveable device 50 are not necessarily directly connected to the shaft; however, based on their association with and positioning with respect to the shaft 52, movement of the rotatable structures may be affected by movement of the shaft 52 to still move shredded materials.

As noted, the movable device 50 is configured to pivot (or rotate and counter rotate) about a pivot point on an axis A4 parallel to axis A1 and/or A2 of the cutter assembly of shredder mechanism 16 (see FIG. 10). It limits and/or temporarily blocks shredded materials from exiting outlet 22. In an embodiment, the movable device 50 pivots back and forth in rapid succession (i.e., in an oscillating manner) as to shed output and falling particles/shredded materials off of at least its surfaces 62, allowing them to pass through a pathway or passageway of the shredder housing 12. This passageway is designed in such a way as to pass safety agency test parameters (such as the UL finger probe test).

In use, the frequency and degree of cyclic and pivotal movement of the shaft 52 can be set or varied. The cycling or pivotal motion helps to shed loose shredded particles from the surfaces of the structures 54 and 56 while aiding in the movement of the shredded particles through the restricted pathway of the shredder housing 12. This motion can also loosen shredded particles dangling or caught within the shredder mechanism 16 (e.g., between strippers and/or cutter elements) as well (alone or with the assistance of structure 56). In an embodiment, the cyclic movement depends on a shape and size of the output opening 22 and/or an amount of shredding material moving through the outlet pathway of the shredder housing 12. In one embodiment, the movable element 50 cycles between approximately 1 cycle per second (or Hertz) (60 cycles per minute) and approximately 15 cycles per second (900 cycles per minute). In another embodiment, the movable element 50 cycles at a relatively slower rate between approximately 1 cycle per second and approximately 5 cycles per second, resulting in relatively larger degree of pivotal movement about the axis A4.

In yet another embodiment, the movable element 50 cycles at a relatively faster rate between approximately 10 cycles per second and approximately 15 cycles per second, resulting in relatively smaller degree of pivotal movement about the axis A4. For example, in such an embodiment, the frequency of movement of the movable device 50 is relatively more rapid and the degree or range of movement is reduced, so as to create a surface (or surfaces) of the movable element 50 that cycle rapidly or vibrate to move shredded materials towards the outlet 22.

The rate at which the movable element 50 is pivoted about its shaft 52 should not be limiting. For example, in an embodiment, the rate may be smaller or larger. In another embodiment, the rate may be variable. It is envisioned that in an embodiment the rate at which the shaft is rotating may be adjusted during shredding. For example, it is envisioned that the cyclic based on the articles or materials being shredded, such as paper versus discs. In another embodiment, the rate which the shaft is rotated may be adjusted based on a detected thickness of article(s) inserted into the throat.

Figure 11A:
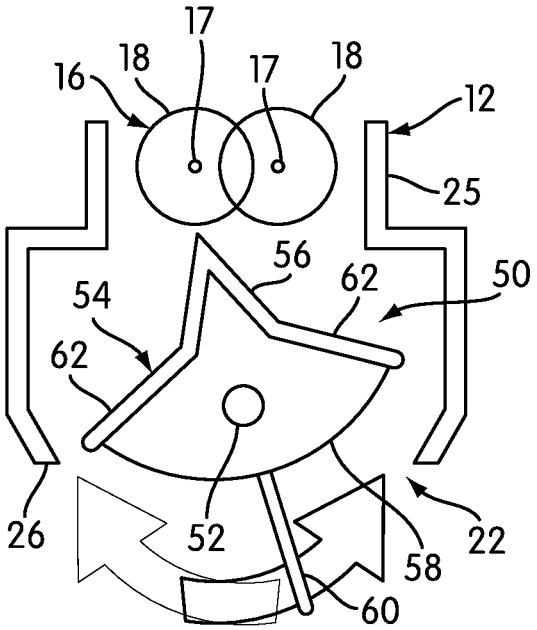
FIGS. 11A and 11B are cross-sectional side views of a shredder housing of a shredder having a movable device in accordance with another embodiment of the disclosure.
Figure 11B:
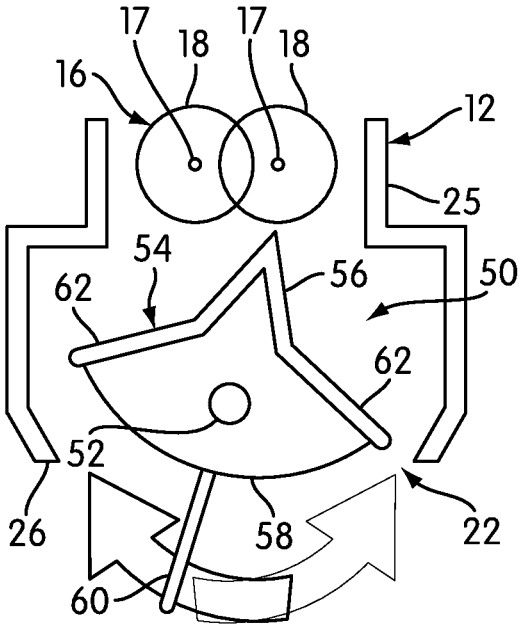

In some embodiments, the movable device 50 extends at least partially out of output side 26 (e.g., into the bin 14), so as to move shredded material(s) accumulated into a pile 28 or uneven peak, for example. FIGS. 11A and 11B show an embodiment of movable device 50 comprising one or more elongate structures 60 for moving shredded materials adjacent to the output side 26. The movable device 50 shown in FIGS. 11A and 11B is configured for pivotal rotation about its axis in a similar manner as described with respect to FIGS. 9A-9B. In an embodiment, one or more elongate structures 60 extends from one or more radially extending structure 58 through output side 26 of the shredder housing 12 (e.g., in a downward direction, or below) and is fixed in positioned on a bottom surface of the structure 58 so as to pivot with the shaft 52 and to distribute an accumulation of shredded materials located adjacent to the output side 26 (e.g., in a bin 14). In some embodiments, elongate structure(s) 60 may be in the form of or shaped like fingers, fins, or paddles (described above). A length of the elongate structure 60 allows it to extend such that it is still able to pivot in at least a part of the outlet 22 and optionally extend at least partially through the outlet 22 beyond the output side 26. In some cases, elongate structure 60 may extend at least partially into a bin (bin 14) provided adjacent to the output side 26 of the shredder 10, to thereby engage and move an accumulation of materials positioned in the bin 14.

In an embodiment, a single elongate structure may be provided. In another embodiment, a plurality of elongate structures 60 may be provided. In an embodiment, each elongate structure 60 extends from a structure 58. In another embodiment, structure 58 may comprise more than one elongate structure 60 extending therefrom. In any of these designs, the elongate structure(s) 60 are designed such that they are able to at least move shredded particles adjacent to the outlet 22.

The elongate structure(s) 60 may be made from any number of resilient materials, such as elastic or rubber, for example, or from a substantially rigid material, such as plastic. In an embodiment, elongate structure(s) 60 may be made from a synthetic nylon or similar material.

The pivotal rotation of axis A4 of the movable device 50 may be activated in any number of ways. In some embodiments, the rotation may be activated manually. For example, a switch may be provided which triggers a motor to start rotation of the movable device 50. In some embodiments, the rotation of the movable device 50 may be activated automatically. In this case, "automatically" activating rotation refers turning or rotating the shaft 52 of the device 50 at the time or detection of a predetermined event or occurrence. For example, the rotation may be associated with the activation of the shredder mechanism 16. The movable device 50 may also be activated to rotate concurrently with the cutter elements 18 of the cutting assembly (e.g., such as when motor 23 is used to rotate both the shredder mechanism 16 and the movable device 50). In some embodiments, the rotation of the movable device 50 is associated with a power switch for turning on the shredder 10. As an option, a positional sensor, such as a Hall sensor, may be used to detect and control the rotational position of the device 50.

In some embodiments, the rotation of the movable device 50 may be associated with one or more sensing devices 36 of the shredder 10, such as "bin full" sensors. The shredder 10 may comprise at least one sensor 36 to detect a presence of shredded materials in relation to the movable device 50, or in relation to the shredder housing 12 and/or mechanism 16. The sensor(s) 36 may be provided on the output (lower) side 26 of the shredder housing 12 (such as shown in FIG. 3). Additionally or alternatively, the sensor(s) may be provided on a side of the bin 14, the output side 26, or in a manner so as to detect an accumulation of shredded materials or particles within the walls of the bin 14. In some embodiments, one or more sensor(s) 36 may be provided to activate the rotation of the shaft 52 of the movable device 50 upon the detection of the presence of shredded materials. In some embodiments, one or more sensor(s) 36 may communicate with a controller to activate the movable device 50 upon reaching or exceeding a predetermined threshold. For example, one such threshold may be upon detection of a level of the shredded materials, e.g., when the bin 14 is detected as full, or detects the accumulation of shredded particles in a pile 28. The movable device 50 may be activated when shredded materials or particles have accumulated to a predetermined capacity (e.g., of 90 percent full), or when the shredded materials appear to be within a predetermined distance below the output (lower) side 26 of the housing 12 (e.g., 2 to 3 inches from the housing 12).

In some embodiments, the movable device 50 may also be implemented in conjunction with a plurality of bin full detectors such as sensors 36 to rotate in a specific direction based on the level of shredded material detected in the waste bin 14 or on the output side 26. The elongate structure 60 of FIGS. 11A-11B may be rotated in conjunction with a reading from sensors 36, for example. In such an implementation, the plurality of sensors 36 may be positioned on the output (lower) side 26 of the shredder housing 12 so as to detect characteristics associated with the pile 28 of shredded materials. For example, the sensors 36 may assist in determining a slope of the pile 28 or its highest position of accumulation. The device 50 may then be activated to rotate in such a way so as to move the shreds from the peak of the pile 28, to either toward a front or back or left or right side(s) of the bin 14 of the shredder 10, depending on the accumulation characteristics in the bin 14. Thus, the movable device 50 may more efficiently distribute the shredded material inside the bin 14.

In some embodiments, such as when the shaft 52 is rotated by a separate motor, a rotary sensing device may be associated with the movable device 50. Such a rotary sensing device may be used to verify that the device 50 rotates to a predetermined position. For example, the elongate structure 60 of the movable device 50 in FIG. 11A may be rotated to a stop such that it is provided in a specific position (e.g., towards a first side or a second, opposite side of the outlet 22). Generally, the elongate structure 60 of the movable device 50 is designed to pivot back and forth in a first direction towards the first side and a second direction towards the second side when activated. However, the movable device 50 may be rotated by a separate motor and stopped such that the elongate device 60 is in a specific position when the shredder power is off. Thus, the rotary sensing device would detect whether the elongate structure 60 is positioned out of the way.

Moreover, in some embodiments, it is envisioned that the surfaces 62 of the blocking structure 58 and structure 54 may be positioned in a specific position such that they are configured to substantially stop shredded materials from passing through the pathway towards the output side 26 and/or through outlet 22. That is, in a similar manner as described above for the fins 34*a* of the rotatable device 30 in FIGS. 7 and 8, the radially extending structures 54 and 56 may be oriented in a position to substantially prevent shredded materials from being discharged from the outlet by limiting the pathway through which shredded materials can fall through in the shredder housing 12.

The cyclic pivoting back and forth motion of the movable device 50 about its axis A4 in the above described embodiments (FIGS. 9A-11B) enables movement of the shredded materials through the pathway of the shredder housing 12 while keeping the underside of the shredder mechanism 16 substantially clean from shredded materials, particles, and related debris. The pivoting motion of the movable device 50 can also create one or more vibrating surface(s) in the shredder housing 12, which assists in knocking and removing particles/shredded materials off of the underside of the cutting elements 18 (cutters and strippers) with the motion of the radially extending structure 56, in addition to shredding shredded materials off its own surfaces (which in turn fall through the outlet 22).

The smaller vibrating movements of the shredder housing 12 and the movable device 50 can also appear less threatening to an observer of the device. Additionally, safety concerns are decreased, as access to pinch points within the device and housing are further restricted.

Also, as described above, the movable device 50 can act as a blocking mechanism, limiting movement of shredded materials through the pathway and acting act as a particle distribution device (distributing shredded materials through the output side 26 and outlet 22. In an embodiment, the blocking elements of the movable device 50 can disperse the particles/shredded materials effectively by strategically placing the movable device 50 in a predetermined pattern. For example, as previously noted, more than one rotatable structure may be provided one or more shafts for rotation. The positioning of two or more rotatable structures may determine how shredded particles will be directed to fall through outlet 22. For example, if a plurality of rotatable structures were staggered relative to one another, particles could be dispensed from the outlet in a predetermined pattern (e.g., determined by the outlet pattern and guiding direction of the structures 54 and 56). In another embodiment, the rate of cyclic movement of the shaft 52 may determined how the shredded materials are output from the outlet 22.

Figure 12:
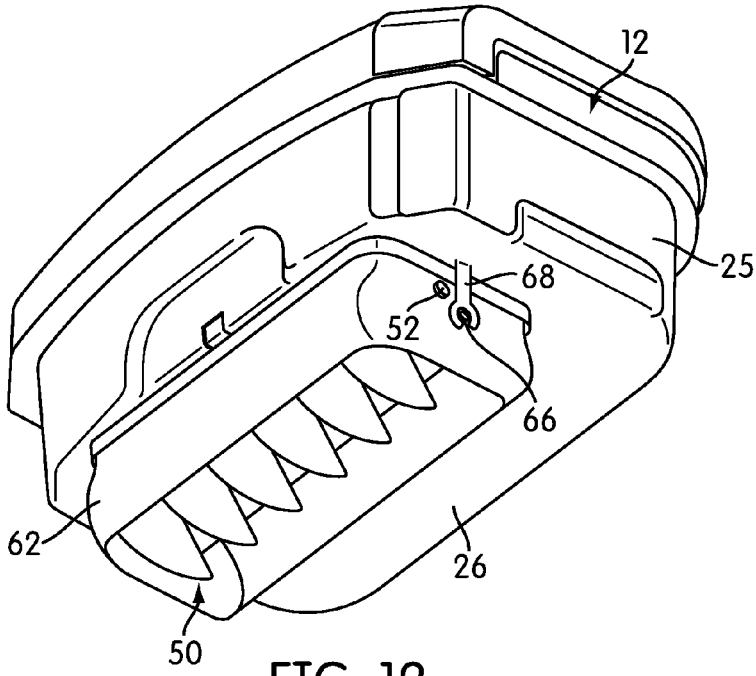
FIGS. 12 and 13 are perspective views of a lower side of a shredder housing with a frame member in a first and second position, respectively, in accordance with an embodiment of the disclosure.
Figure 13:
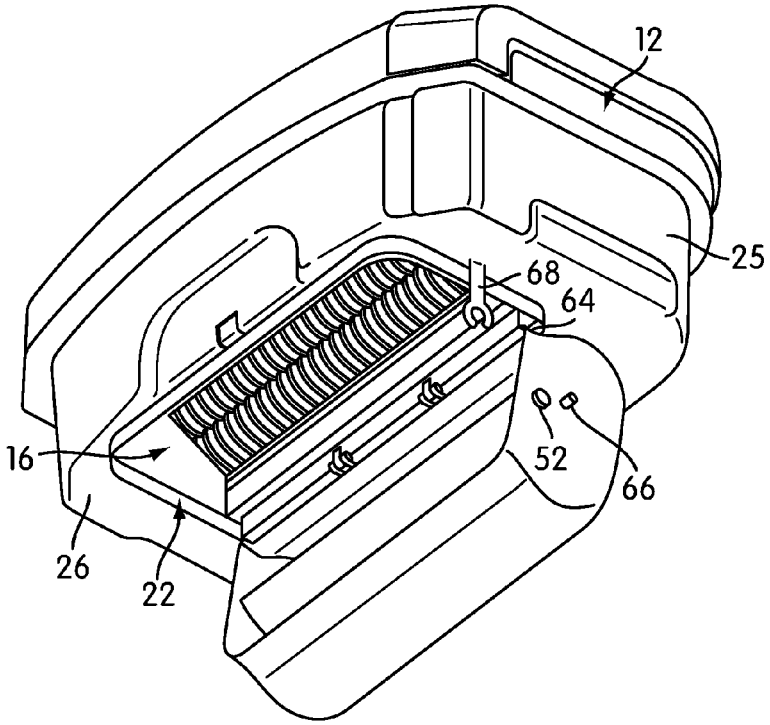

As previously noted above, the illustrated devices may be mounted within or adjacent the shredder housing 12. In some embodiments, the devices may be mounted in bottom receptacle 25. In an embodiment, the bottom receptacle 25 may comprise a plurality of parts. For example, FIGS. 12 and 13 illustrate an output (lower) side 26 of shredder housing 12, including a frame member 62. The frame member 62 forms a passageway from the output of the shredder mechanism to the output side 26 of the shredder housing 12. In an embodiment, frame member 62 supports the movable device 50, i.e., the shaft 52 of the movable device 50 is mounted to the frame member 62.

In an embodiment, the frame member 62 is connected via a hinge 64 to a surface (e.g., underside) of the shredder housing 12 that is positioned adjacent to the output of the shredder mechanism 16. The frame member 62 is configured to pivot or swing about the hinge 64 from a first position (see FIG. 12) for shredding to a second position (see FIG. 13) to provide access to the output opening and the cutter assembly of the shredder mechanism 16. For example, the frame member 62 may be moved out of the way if there is need to manually remove bird nested or built up particles within and/or adjacent to the shredder mechanism 16 or within movable mechanism 50 (e.g., within an interior of the frame member 62).

In an embodiment, frame member 62 has one or more interlock switches which activate when force is applied by an object, finger or hand to the frame member 62 and pressing upwards towards the cutter assembly. The switches may be configured to determine an amount of force applied to at least the frame member 62. The pivoting of the frame member 62 about the hinge 64 may be automatically triggered upon a determination of a predetermined amount of force being applied to at least the frame member 62. For example, a latching system that opens only when a predetermined amount of force is placed upon the outlet and its supporting frame may be implemented with the shredder housing 12. In an embodiment, the frame in turn could use an alternate or additional interlock switch which activates when enough force is exerted from the cutting assembly/shredder mechanism 16 downwards upon the movable device 50 and/or frame member 62. Such a situation might occur when an operator attempts to shred beyond the recommended sheet count (too many sheets), causing shredded particles to bunch up or "bird nest" below the cutter assembly in such a way as to not pass through or by the movable device 50 and outlet path. This "bird nest" build up will enlarge within the paper outlet path as to exert enough force on movable device 50 and supporting frame member 62 to activate the interlock switch. The activation or triggering of the switch occurs before the movable device 50 (and the cutting assembly) is damaged by the build up of materials.

Figure 14:
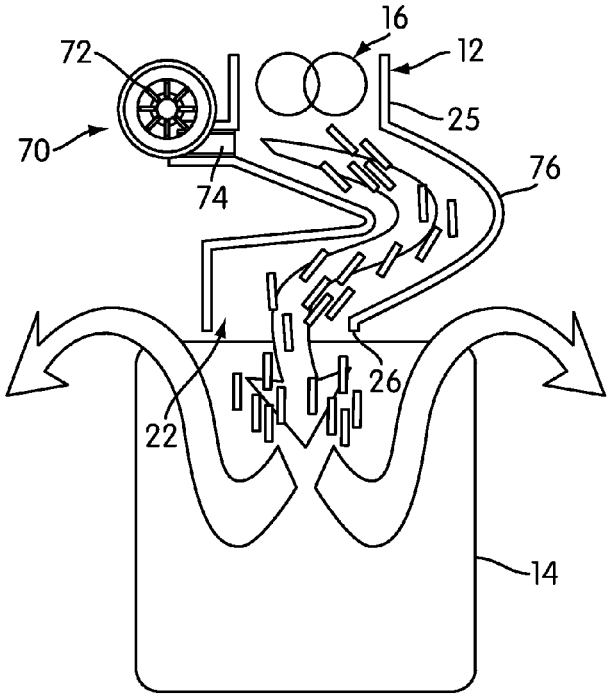
FIGS. 14 and 15 are schematic side views of a shredder housing of a shredder having a fan mechanism in accordance with yet another embodiment of the disclosure.
Figure 15:
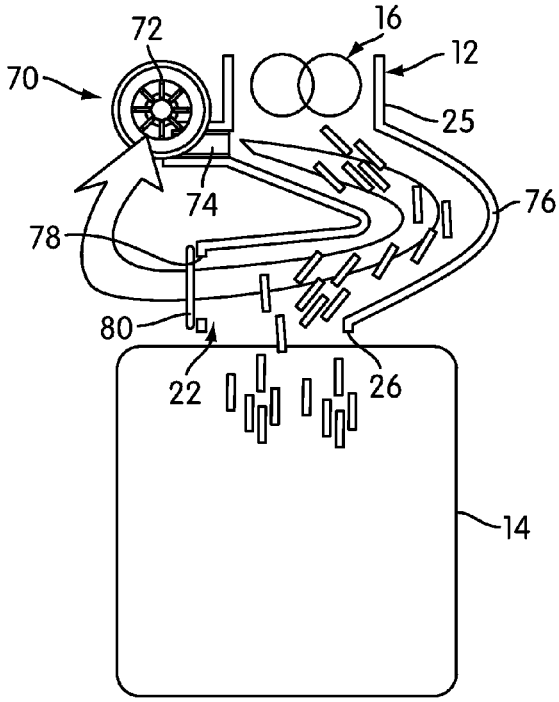

FIGS. 14 and 15 are schematic side views of a shredder housing of a shredder having a fan mechanism 70 in accordance with yet another embodiment. The fan mechanism 70 is constructed and arranged to provide forced air towards the output opening 22 and output side 26 to move the shredded material at least adjacent to the output opening 22. Arrows are provided in both FIGS. 14 and 15 as exemplary illustrations for movement of forced air from the fan mechanism 70. In an embodiment, forced air is also directed through the output opening 22, thereby moving shredded materials through (within) and adjacent output opening 22. In an embodiment, as shown in FIG. 14, a bin 14 for receiving shredded materials may be provided adjacent to the output side 26 of the shredder housing 12. The exhaust or forced air that is blown out of the output side 26 can be forced and directed to enter (and exit) into the bin 14. The forced air that enters the bin 14 can distribute an accumulation of shredded materials within the bin 14 (e.g., move and flatten shredded material therein to prevent formation of uneven piles 28).

Fan mechanism 70 comprises a fan with air inlet 72 and a fan exhaust or blower nozzle 74 that is used to direct output (forced) air adjacent to an output of the shredder mechanism 16 and towards output side 26. The inlet 72 draws air from the outside, for example, when the fan blades of the fan mechanism are being rotated. In an embodiment, a filter may be provided in inlet 72 to filter particles that may be drawn in by the fan (e.g., paper pieces, dust, etc.). The fan mechanism 70 uses a drive system or motor to activate fan blades and output forced air through nozzle 74. In an embodiment, the fan mechanism 70 may use the motor 23 (used to rotate the cutting block assembly) for its activation. This can eliminate the need for an additional motor. In another embodiment, the fan mechanism 70 is provided with a separate motor or drive system.

In an embodiment, the fan mechanism 70 is mounted within the shredder housing 12. In an embodiment, the fan mechanism 70 is mounted in the shredder 10 such that its blower nozzle 74 is positioned to direct air adjacent to the shredder mechanism 16. In another embodiment, the fan mechanism 70 is mounted on an upper side of the shredder housing 12. In yet another embodiment, the fan mechanism 70 is mounted on a lower side of the shredder housing 12.

In one embodiment, bottom receptacle 25 may comprise a frame member forming a passageway 76 from the output of the shredder mechanism 16 to the output side 26 of the shredder housing 12. The fan mechanism 70 may be positioned to circulate and/or force air in the passageway 76. Thus, in addition to providing air towards the output side 26 to move adjacent shredded material, the output forced air may be used to move shredded material through the passageway 76 and towards the output side 26 of the shredder housing 12.

The passageway 76 can comprise any shape, and it not meant to be limiting. For example, as shown in the Figures, passageway 76 comprises a curved shape, in the form of a letter "C" (seen in reverse) with one portion extending downward and laterally away from the fan and shredder outlet, and the other portion extending downward and back towards the output opening 26 or bin 14. However, linear or other shapes may also be used.

The rotation and power to the fan mechanism 70 for supplying output of forced air towards the output side 26 of the shredder housing 12 may be activated in any number of ways. In some embodiments, the output may be activated manually. For example, a switch may be provided which triggers a motor to start rotation of the fan in fan mechanism 70. In some embodiments, the output of the fan mechanism 70 may be activated automatically. In this case, "automatically" activating rotation refers turning or rotating the fan of the fan mechanism 70 at the time or detection of a predetermined event or occurrence. For example, the output of forced air may be associated with the activation of the shredder mechanism 16. The fan mechanism 70 may also be activated for output of forced air concurrently with the rotation of the cutter elements 18 of the cutting assembly (e.g., such as when motor 23 is used to rotate both the shredder mechanism 16 and the fan). In some embodiments, the output of forced air from the fan mechanism 70 is associated with a power switch for turning on the shredder 10. As an option, at least one sensor may be used in the shredder to detect a presence of shredded materials in relation to the device (e.g., being deposited adjacent to the fan mechanism), so as to activate the fan mechanism upon the detection of the presence of shredded materials. In some embodiments, the fan mechanism 70 may be activated periodically. In an embodiment, the drive system comprises a timer for controlling at least the start time or activation of fan mechanism 70. In an embodiment, the same or a different timer may be used for running the fan mechanism 70. For example, the fan mechanism 70 may be activated after a time period of shredding. The fan mechanism 70 could also or alternatively be activated for a predetermined time period. For example, the fan mechanism 70 may be activated to output forced air towards output side 26 for 1 minute after 5 minutes of shredding.

In an embodiment, shown in FIG. 15, the frame member comprises a vent 78 within its passageway 76 to allow forced air to escape therefrom. The vent 78 may have a filter 80 to prevent shredded materials from escaping through the vent 78. In embodiment, the forced air escaping the vent 78 and blown out of the passageway 76 is recycled and utilized as input for the inlet 72 of the fan mechanism 70.

Accordingly, the fan mechanism 70 is activated to produce an air turbulence within the interior of the frame member. The fan 70 can also force air through the passageway 76 and towards the output side 26.

Many of the advantages listed previously also apply to this embodiment. For example, fan mechanism 70 assists in cleaning shredded materials from the output side of the shredder mechanism 16 and/or cutting assembly, as well as near the output (lower) side 26 of the shredder housing 12 (e.g., such as in the bin 14), thereby preventing accumulation of materials (such as piling or bird nesting).

Figure 16:
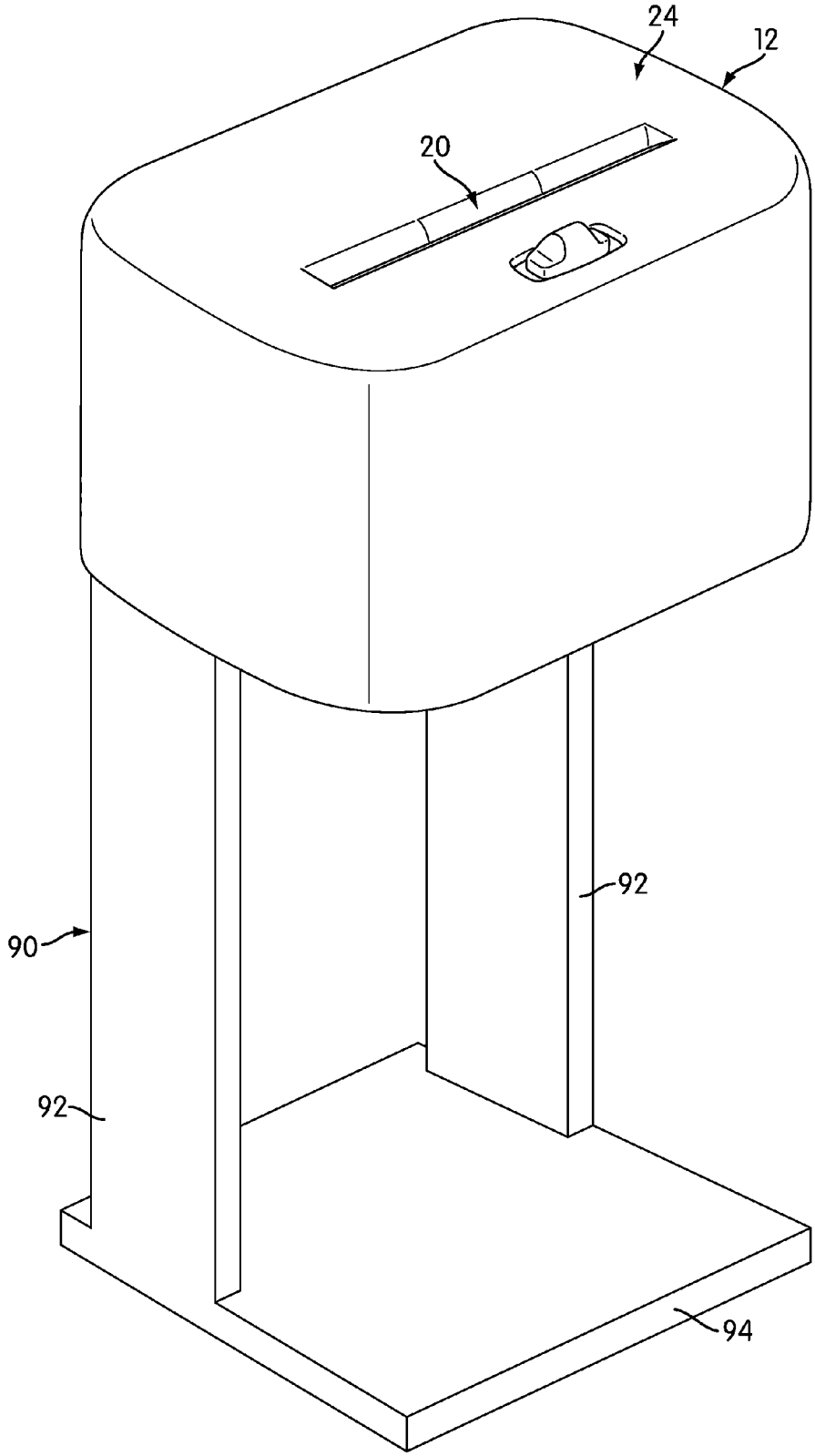
FIG. 16 is a perspective view of a shredder housing mounted on a frame in accordance with an embodiment of the disclosure.

Although shredder housing 12 may be mounted directly on top of a bin 14, such as shown in FIGS. 2 and 7, for example, shredder housing 12 may also be mounted separate but relative to a bin 14. FIG. 16 illustrates a shredder housing 12 mounted on a frame 90 in accordance with an embodiment of the disclosure. Generally, the frame 90 as illustrated in FIG. 16 comprises two legs 92 and a base 94 with an open front and back. The frame 90 as illustrated in FIG. 16 is configured to support the shredder housing 12 at an elevated position using a minimal structure.

Either a bag or waste bin can be positioned relative to (e.g., under) the shredder housing 12. In an embodiment, the size of the frame 90 and the lengths of its legs 92 may be determined based on an approximate size of the device used to capture shredded materials (e.g., a size of a bin or container) to be positioned below the outlet 22/output side 26 of the shredder housing 12.

In an embodiment, the shredder housing 12 in FIG. 16 utilizes one of the embodiments of the movable device 50 described with respect to FIGS. 9A-13. For example, the supporting frame member 62 offers a safer design that limits access to at least the outlet of the shredder mechanism 16 within the shredder housing 12. Thus, a bag or bin can be easily placed and removed relative to the housing 12 without risk of injury. Accordingly, access to such a bag or bin is simplified by frame 90, and the structure 90 is minimized. There is no need to open a bin door or lift the shredder housing 12 from a container to empty and remove shredded materials.

Also, with the removal of the cabinetry around the shredder bin, the shredder housing 12 becomes a self contained device that can be supported over any number of edges, not just a specifically designed container or cabinet. The reduction in cabinetry allows for a simpler, more cost effective design which can be constructed with less concern for additional safety precautions (other than its own stability), particularly since the shredder housing may utilize a safety interlock mechanism assembly. That is, the movable devices and/or its cabinetry described herein (including embodiments described below) themselves act as a safety device, and, therefore, do not necessarily need sensors and/or systems that are activated/deactivated based on a relative movement of the shredder housing to a container or cabinet, or the like. Instead, the movable device assists in substantially reducing and/or preventing insertion of user hands or fingers into the shredder mechanism 16 and/or into contact with cutting elements 18 by reducing and/or preventing access to the outlet and underside of the shredder mechanism 16. The moveable devices still allow shredded particles to exit the outlet, but impede or restrict insertion of a user's fingers or small appendages from entering the outlet, including during shredding.

Figure 17:
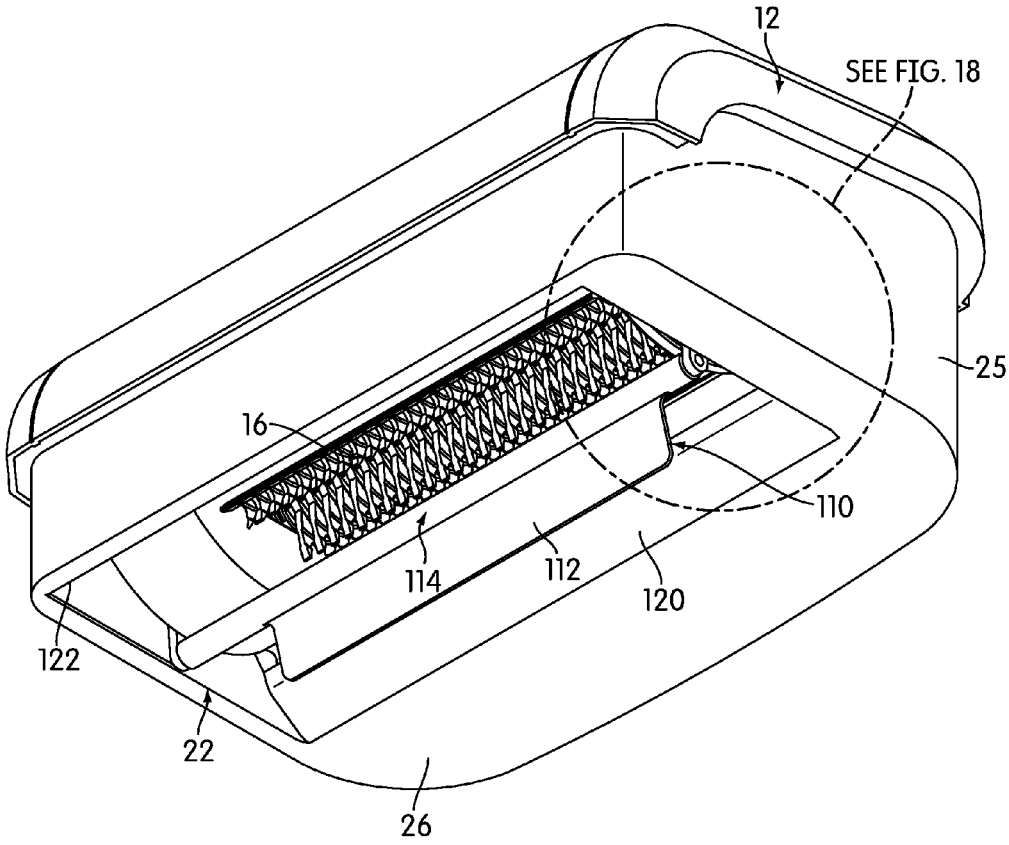
FIG. 17 is a perspective view of a lower side of a shredder housing of a shredder having a movable device in accordance with yet another embodiment of the disclosure.
Figure 18:
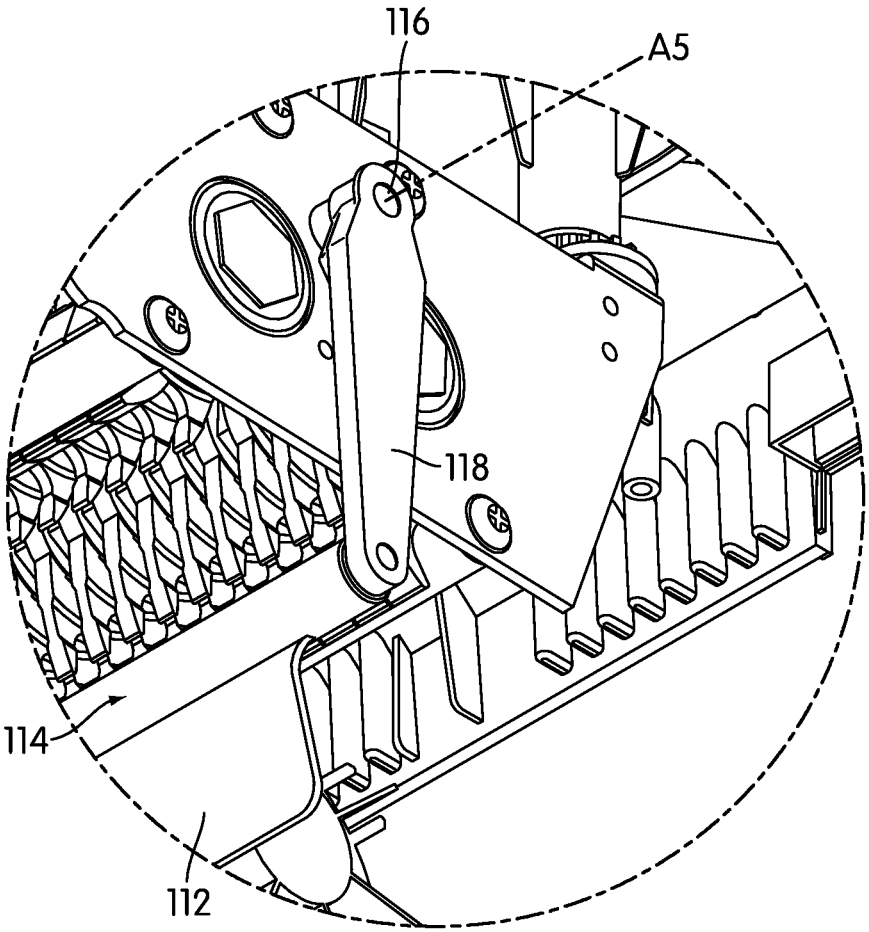
FIG. 18 shows a detailed perspective view of parts of the movable device of FIG. 17.
Figure 19:
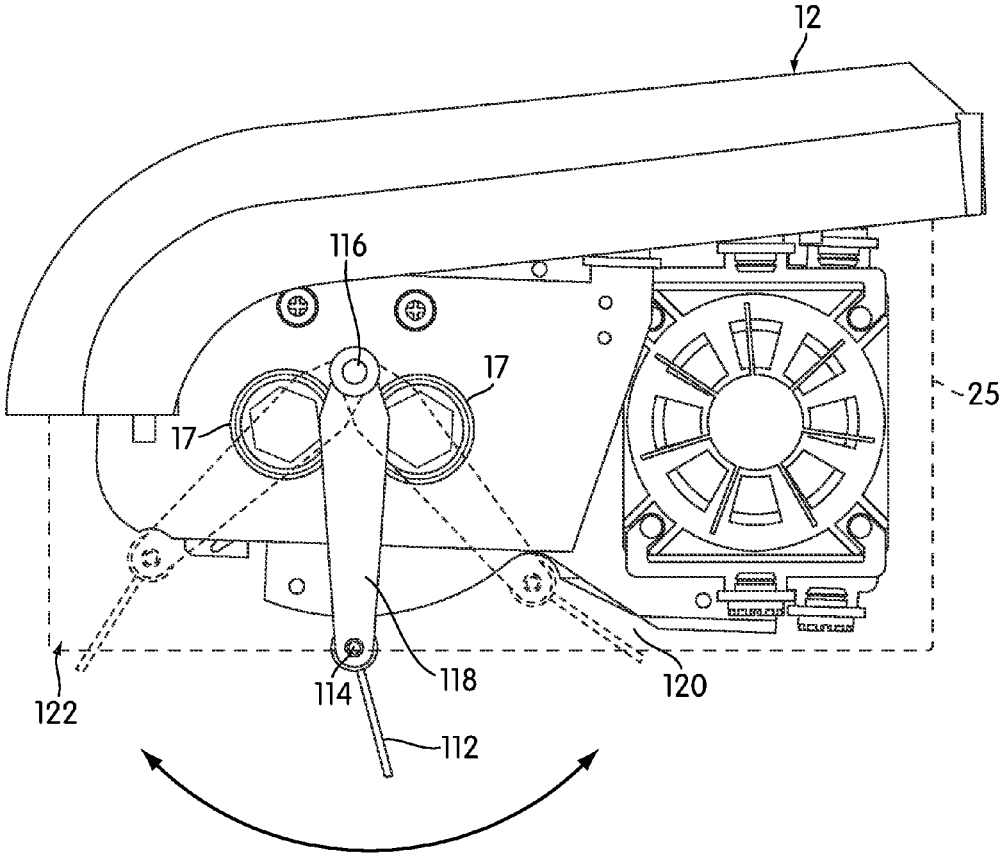
FIG. 19 illustrates a side view of the shredder housing of FIG. 17 showing movement of the moveable device relative to the shredder mechanism therein.

FIGS. 17-19 illustrate yet another alternate embodiment of a movable device 110 provided in a shredder housing of a shredder, such as shredder 10. FIGS. 17-19 have some similar features as previously described, and therefore similar reference numerals have been used. For example, FIGS. 17-19 show shredder mechanism 16 in shredder housing 12 that includes a drive system with at least one motor 23, such as an electrically powered motor, and a cutter assembly comprising a plurality of cutter elements 18. The cutter elements 18 of cutter assembly are mounted on a pair of parallel mounting shafts. Shredder housing 12 also comprises an output opening 22 or outlet on an output side 26 (or lower side or bottom side or bottom wall or underside or bin side or output side). In the illustrated embodiment, shredder housing 12 includes a bottom receptacle 25 to receive shredder mechanism 16 therein. Bottom receptacle 25 may include output opening or outlet 22 in its lower side 26 through which shredded material is deposited into a bin. The bottom receptacle 25 and/or outlet 22 may reside within or adjacent the opening of the bin so as to direct shredded particles into the bin. As further described below, bottom receptacle 25 may comprise a unitary structure or several parts, including a frame member or members connected together. Generally speaking, the shredder 10 may have any suitable construction or configuration and the illustrated embodiments provided herein are not intended to be limiting in any way.

Movable device 110 is provided within shredder 10 to assist in reducing such issues as crowning, piling, and bird nesting, discussed above. More specifically, movable device 110 is provided or mounted in relation to the output side 26 of the shredder housing 12 to assist in moving shredded materials caught in or around the cutting assembly and in bottom receptacle 25. Movable device 110 is positioned at least partially between the shredder mechanism 16 and the output side 26. Movable device 110 may be positioned adjacent the output opening or outlet 22, and/or adjacent an output of the shredder mechanism 16. The movable device 110 is configured to move shredded material positioned at least adjacent to at least the output opening 22 on output side 26 of shredder housing 12, as will be further described below. In an embodiment, movable device 110 can move shredded material positioned within and adjacent output opening 22

The movable device 110 comprises an auxiliary shaft 116 configured to rotate or pivot about a parallel, lateral axis A5 adjacent the axes A1 and A2 of the cutter elements 18 of the cutter assembly. The shaft 116 of the movable device 110 may be positioned relative to the shredder mechanism 16. In some embodiments, the shaft 116 may be positioned above or below the cutter elements, as generally illustrated in FIG. 19, which shows an end view of cutting shaft elements 17 (represented by an end of cutting shaft bearings having a hex shape), upon which cutter elements 18 are mounted. In some embodiments, the shaft 116 is mounted within the shredder housing 12 or, alternatively, within the shredder mechanism 16. The shaft 116 is configured to rotate or pivot about axis A5 in any direction in an oscillating manner, e.g., in a clockwise direction and/or a counterclockwise direction, as well as alternate between each direction. In some embodiments, the shaft 116 of the movable device 110 is driven by the motor 23 rotating the cutter elements 18 of the cutting assembly. In some embodiments, the shaft 116 of the movable device 110 is rotated or pivoted by a separate motor (not shown).

Movable device 110 may comprise one or more rotatable structures or flaps 112 extending at least partially radially with respect to the shaft 114 in a perpendicular direction in relation to the parallel axis A (i.e., in a radial direction). A "flap" as provided herein is defined as an elongated structure that generally extends or stands radially in relation to the shaft 112 and/or shaft 114. In some embodiments, flap(s) 112 may be in the form of or shaped like fingers, fins, or paddles (described above). As shown in FIGS. 17 and 19, in an embodiment, a flap 112 may be provided on a second auxiliary shaft 114 that is positioned parallel to auxiliary shaft 116. Specifically, auxiliary shaft 116 may be mounted adjacent to the shredder mechanism 16 and include arms 118 at its ends that are positioned to extend in a downward direction towards the output opening 22 (a detail of one arm 118 is shown in FIG. 18). The arms 118 are connected at their first end to shaft 116 and are configured to rotate and/or pivot with shaft 116. At their second end, arms 118 are connected to second auxiliary shaft 114. As shown in detail in FIG. 18, flap 112 may be mounted on or around second auxiliary shaft 114. In an embodiment, the flap 112 is connected to and extends radially with respect to a surface of the second auxiliary shaft 114. In one embodiment, flap 112 is integrally formed on the shaft 114.

In an embodiment, second auxiliary shaft 114 is connected to second end of arms 118 such that it is rotationally stationary. In another embodiment, second auxiliary shaft 114 is connected to arms 118 so that it can pivot about an axis.

Flap 112 may be connected to shaft 114 such that it is positioned to extend from and be rotationally stationary relative to the shaft 114. Flap 112 may be positioned at a predetermined angle relative to shaft 114, for example. In another embodiment, flap 112 may be configured to rotate relative to a stationary second auxiliary shaft 114. In yet another embodiment, flap 112 may be connected to shaft 114 such that it is rotationally stationary relative to the shaft 114, but configured to rotate or pivot with the movement of the shaft 114.

In some embodiments, the movable device 110 extends at least partially out of output side 26 (e.g., into the bin 14), so as to move shredded material(s) accumulated into a pile 28 or uneven peak, for example. As shown in FIG. 19, for example, the flap 112 may be configured to be positioned to optionally extend at least partially through and/or below the output opening 22 and bottom wall of output side 26. In some cases, flap 112 may extend at least partially into a bin (bin 14) provided adjacent to the output side 26 of the shredder 10, to thereby engage and move an accumulation of materials positioned in the bin 14. A length of each the arms 118 may be configured to position the second auxiliary shaft 114 and its flap 112 through the output opening 22. In another embodiment, the length of the flap 112 is used to position at least part of its surface through the output opening 22.

Accordingly, although FIGS. 17-19 illustrate a singular rotatable structure in the form of a flap 112, it should be understood that movable device 110 may comprise more than one singular rotatable structure. In an embodiment, movable device 110 may comprise a plurality of rotatable structures mounted on or along the second auxiliary shaft 114. Also, the elongate structure(s) 112 may be made from any number of resilient materials, such as elastic or rubber, for example, or from a substantially rigid material, such as plastic. In an embodiment, elongate structure(s) 112 may be made from a synthetic nylon or similar material.

The movable device 110 may be configured to move second auxiliary shaft 114 and its flap 112 from back wall 120 to front wall 112 of the outlet opening 22. In an embodiment, the movable device 110 may be configured to be temporarily positioned or locked from movement within and/or adjacent the output opening. For example, a stopping or clutching mechanism may be provided in the shredder which is configured to selectively and temporarily hold or stop movable device 110 from moving. In an embodiment, the movable device 110 may be configured to be selectively activated (e.g., via a sensor or a manual switch on the housing) to move shredded particles within and/or adjacent the output opening 22. When movable device 110 is not in use, it may be moved or pivoted towards back wall 120 or front wall 122 after receiving instructions to stop, so that the shaft 114 and flap 112 are positioned out of the way to allow for free fall of shredded particles from the shredder mechanism 16.

As noted, the movable device 110 is configured to pivot (or rotate and counter rotate) about a pivot point on an axis A5 parallel to axis A1 and/or A2 of the cutter assembly of shredder mechanism 16 (see FIG. 18). In an embodiment, the movable device 110 pivots back and forth in an oscillating manner to move shaft.

In use, the frequency and degree of cyclic and pivotal movement of the shaft 116 can be set or varied. As previously noted, the movable device 110 may be configured to move such that the shaft 114 and its flap 112 are moved between and relative to the back wall 120 and front wall 112 of the output opening 22. In an embodiment, the movement depends on a shape and size of the output opening 22 and/or an amount of shredding material moving through the outlet pathway of the shredder housing 12. In one embodiment, the movable element 50 cycles between approximately 1 cycle per second (or Hertz)(60 cycles per minute) and approximately 15 cycles per second (900 cycles per minute). In another embodiment, the movable element 50 cycles at a relatively slower rate between approximately 1 cycle per second and approximately 5 cycles per second, resulting in relatively larger degree of pivotal movement about the axis A5. In yet another embodiment, movable element 50 cycles around approximately ½ cycle per second (with substantially full motion).

In yet another embodiment, the movable device 110 cycles at a relatively faster rate between approximately 10 cycles per second and approximately 15 cycles per second, resulting in relatively smaller degree of pivotal movement about the axis A5. For example, in such an embodiment, the frequency of movement of the movable device 50 is relatively more rapid and the degree or range of movement is reduced, so as to move shredded materials towards the outlet 22.

The rate at which the movable element 110 is pivoted about its auxiliary shaft 116 should not be limiting. For example, in an embodiment, the rate may be smaller or larger. In another embodiment, the rate may be variable. It is envisioned that, in an embodiment, the rate at which the shaft is rotating may be adjusted during shredding. For example, it is envisioned that the cyclic based on the articles or materials being shredded, such as paper versus discs. In another embodiment, the rate which the shaft is rotated may be adjusted based on a detected thickness of article(s) inserted into the throat. Also, as previously noted, the motion can be selectively stopped.

The pivotal rotation of axis A5 of the movable device 110 may be activated in any number of ways. As previously noted, in some embodiments, the rotation may be activated manually. For example, a switch may be provided which triggers a motor to start rotation of the movable device 110. In some embodiments, the rotation of the movable device 110 may be activated automatically. In this case, "automatically" activating rotation refers turning or rotating the shaft 116 of the device 110 at the time or detection of a predetermined event or occurrence. For example, the rotation may be associated with the activation of the shredder mechanism 16. The movable device 110 may also be activated to rotate concurrently with the cutting shaft elements 17 and cutter elements 18 of the cutting assembly (e.g., such as when motor 23 is used to rotate both the shredder mechanism 16 and the movable device 110). In some embodiments, the rotation of the movable device 110 is associated with a power switch for turning on the shredder 10. As an option, a positional sensor, such as a Hall sensor, may be used to detect and control the rotational position of the device 110.

In some embodiments, the rotation of the movable device 110 may be associated with one or more sensing devices 36 of the shredder 10, such as "bin full" sensors. The shredder 10 may comprise at least one sensor 36 to detect a presence of shredded materials in relation to the movable device 110, or in relation to the shredder housing 12 and/or mechanism 16. The sensor(s) 36 may be provided on the output (lower) side 26 of the shredder housing 12 (such as shown in FIG. 3). Additionally or alternatively, the sensor(s) may be provided on a side of the bin 14, the output side 26, or in a manner so as to detect an accumulation of shredded materials or particles within the walls of the bin 14. In some embodiments, one or more sensor(s) 36 may be provided to activate the rotation of the shaft 116 of the movable device 110 upon the detection of the presence of shredded materials. In some embodiments, one or more sensor(s) 36 may communicate with a controller to activate the movable device 110 upon reaching or exceeding a predetermined threshold. For example, one such threshold may be upon detection of a level of the shredded materials, e.g., when the bin 14 is detected as full, or detects the accumulation of shredded particles in a pile 28. The movable device 110 may be activated when shredded materials or particles have accumulated to a predetermined capacity (e.g., of 90 percent full), or when the shredded materials appear to be within a predetermined distance below the output (lower) side 26 of the housing 12 (e.g., 2 to 3 inches from the housing 12).

In some embodiments, like movable device 50, the movable device 110 may also be implemented in conjunction with a plurality of bin full detectors such as sensors 36 to rotate in a specific direction based on the level of shredded material detected in the waste bin 14 or on the output side 26. Such sensors are described above with respect to movable device 50 and are therefore not repeated here.

In some embodiments, the movable device and/or its associated components may trigger a bin full indication. For example, as previously noted, a stopping or clutching mechanism may be provided in the shredder which allows a movable device such as device 110 to be held or stopped. In an embodiment, when movable device 110 stops during its articulation (e.g., due to a detected bin level particle height), the clutching mechanism can be used to activate a bin full switch to indicate to a user that the bin is full. That is, the clutching mechanism can work along with the sensor and the switch. The stopping or clutching mechanism can also be used while discouraging drive mechanism damage. When device 110 is held or stopped (e.g., due to particles blocking the movement (which actuates the bin full switch) and/or due to manual movement of the device by hand), it can be held by the clutching mechanism in a position such that there is no damage to the drive mechanism attached to or associated with shaft 116.

In some embodiments, such as when the shaft 116 is rotated by a separate motor, a rotary sensing device may be associated with the movable device 110. Such a rotary sensing device may be used to verify that the device 110 rotates to a predetermined position. For example, the shaft 116 may be rotated so that its arms 118 and thus shaft 114 and flap 112 are moved to a stop such that it is provided in a specific position (e.g., towards a first side/back wall 120 or a second, opposite side/front wall 120 of the outlet 22). Generally, the movable device 110 is designed to pivot back and forth in a first direction towards the first side/back wall 120 and a second direction towards the second side/front wall 112 when activated. However, the movable device 110 may be rotated by a separate motor and stopped such that the shaft 114 and flap 112 are in a specific position when the shredder power is off. Thus, the rotary sensing device would detect whether the shaft 114 and flap 112 are positioned out of the way.

The cyclic pivoting back and forth motion of the movable device 110 about its axis A5 in the above described embodiments (FIGS. 17-19) enables movement of the shredded materials through the pathway of the shredder housing 12 while keeping the underside of the shredder mechanism 16 substantially clean from shredded materials, particles, and related debris. The pivoting motion of the movable device 110 can also create one or more vibrating surface(s) in the shredder housing 12, which assists in knocking and removing particles/shredded materials off of the underside of the cutting elements 18 (cutters and strippers), in addition to shredding shredded materials off its own surfaces (which in turn fall through the outlet 22).

The smaller vibrating movements of the movable device 110 can also appear less threatening to an observer of the device. Additionally, safety concerns are decreased, as access to pinch points within the device and housing are further restricted.

It should be understood that any of the described embodiments and/or shredders may be used in correlation with any number and type of sensing devices. For example, as mentioned above with respect to some embodiments, the shredder may comprise one or more waste level or bin full sensing devices operable to detect an accumulation of shredded particles discharged by the shredder mechanism. That is, the waste level sensor may determine an amount of space available in container or bin 14 for collecting shredded particles. In embodiments, the waste level sensing device(s) may be devices which utilize light or radiation for bin full detection, such as the examples described in U.S. patent application Ser. No. 12/355,589, filed Jan. 16, 2009, and U.S. Pat. No. 6,978,954, issued Dec. 27, 2005, both assigned to the same assignee of the present disclosure. The waste level sensor(s) may comprise a single device for emitting and detecting radiation or a plurality (e.g., two or more) light-emitting diodes (LEDs) or optical sensors, and a detection sensor. The radiation emitted by the sensors may include light in the visible spectrum, infrared radiation (IR), and/or ultraviolet radiation. Shredded particles being discharged by the shredder mechanism and accumulated in the container or bin will be detected by the sensing device(s). Generally, any number of LED or other sensing devices may be provided, and mounted in several ways, and therefore should not be limiting. Of course, other types of sensors may also be used for bin full detection. For example, in embodiments, waste level sensing device(s) may utilize sonic detection, wherein ultrasonic waves are reflected and detected to determine an amount of shredded particles in a container. Generally, sensors with ratio metric output may be used to determine a waste level in a bin.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the objects of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A shredder comprising:

a shredder housing having a shredder mechanism mounted therein, the shredder housing comprising an input opening for receiving materials and an output opening for depositing shredded material therefrom, the output opening being open to an output side of the shredder housing;

the shredder mechanism including a motor and a cutter assembly, the motor rotating the cutter assembly to shred materials fed therein, and a movable device positioned at least partially between the shredder mechanism and the output side, the movable device comprising a shaft and one or more radially extending structures extending at least partially radially with respect to the shaft, and wherein the shaft is configured to pivot about an axis parallel to an axis of the cutter assembly in an oscillating manner so as to use the one or more radially extending structures to move shredded materials within and adjacent to the output opening, wherein the one or more radially extending structures of the movable device extend into the cutter assembly so as to move shredded materials caught in or around the cutter assembly.

2. The shredder according to claim 1, wherein the shaft of the movable device is positioned below the shredder mechanism.

3. The shredder according to claim 1, wherein the shaft of the movable device is mounted within or adjacent the shredder housing.

4. The shredder according to claim 1, wherein the shaft of the movable device is driven by the motor rotating the cutter assembly.

5. The shredder according to claim 1, wherein one or more of the one or more radially extending structures comprises at least one surface to catch or redirect shredded materials deposited from the shredder mechanism.

6. The shredder according to claim 1, wherein one or more of the one or more radially extending structures comprises an elongate structure extending downwardly through the output side and fixed in position on a bottom surface of the radially extending structure so as to pivot with the shaft and to distribute an accumulation of shredded materials located adjacent to the output side.

7. The shredder according to claim 6, wherein the elongate structure is made from an elastic or rubber material.

8. The shredder according to claim 1, further comprising a bin for receiving shredded materials provided adjacent to the output side and wherein the one or more radially extending structures of the movable device extend at least partially into the bin.

9. The shredder according to claim 8, wherein the one or more radially extending structures of the movable device are configured to engage and move an accumulation of shredded materials positioned in the bin.

10. The shredder according to claim 6, wherein the elongate structure extends at least partially into a bin located below the output side.

11. The shredder according to claim 10, wherein the elongate structure is configured to engage and move an accumulation of shredded materials in the bin.

12. The shredder according to claim 1, wherein the movable device is mounted on a lower side of the shredder housing.

13. The shredder according to claim 1, further comprising a frame member forming a passageway from the output of the shredder mechanism to the output side of the shredder housing, and wherein the shaft of the movable device is mounted to the frame member.

14. The shredder according to claim 13, wherein the frame member is connected via a hinge to a surface of the shredder housing positioned adjacent to the output of the shredder mechanism, and wherein the frame member is configured to pivot about the hinge to provide access to the output opening and the cutter assembly of the shredder mechanism.

15. The shredder according to claim 14, further comprising one or more switches configured to determine an amount of force applied to at least the frame member, and wherein the pivoting of the frame member about the hinge is automatically triggered upon a predetermined amount of force determined as being applied to at least the frame member.

16. The shredder according to claim 1, wherein the rotation of the movable device is manually activated by a switch.

17. The shredder according to claim 1, wherein the shredder further comprises at least one sensor to detect a presence of shredded materials in relation to the movable device so as to activate the pivoting of the shaft of the movable device upon the detection of the presence of shredded materials.

18. The shredder according to claim 1, wherein the shredder further comprises a plurality of sensors to determine a slope of an accumulation of shredded materials adjacent to the output side.

19. The shredder according to claim 18, wherein the movable device is configured for movement in a direction to distribute the accumulation of shredded materials in the bin based on the determined slope.

20. The shredder according to claim 1, wherein pivoting of the movable device is activated upon activation of the cutting assembly.

21. The shredder according to claim 20, wherein the pivoting of the movable device is activated to move concurrently with the cutting assembly.

22. The shredder according to claim 1, further comprising a clutching mechanism configured to selectively and temporarily hold the movable device from pivoting from a predetermined position.

23. The shredder according to claim 22, further comprising a bin full sensor or switch to indicate to a user that the bin is full, and wherein use of the clutching mechanism to selectively and temporarily hold the movable device in the predetermined position is configured to activate the bin full sensor or switch.

24. A method for moving shredded materials in a shredder, the method comprising:

feeding material to be shredded into an input opening in a shredder housing of the shredder;

shredding the material with a shredder mechanism mounted in the shredder housing, the shredder mechanism including a motor and a cutter assembly, the motor rotating the cutter assembly to shred materials fed therein;

depositing the shredded material via an output opening in the shredder housing, the output opening being open to an output side of the shredder housing; and pivoting a shaft of a movable device about an axis that is parallel to an axis of the cutter assembly in an oscillating manner, the movable device being positioned at least partially between the shredder mechanism and the output side and the shaft of the movable device having radially extending structures associated therewith and extending at least partially radially with respect to an axis of the shaft so as to move shredded materials within and adjacent to the output opening, wherein the radially extending structures of the movable device extend into the cutter assembly so as to move shredded materials caught in or around the cutting assembly during the pivoting of the shaft of the movable device.

25. The method according to claim 24, wherein the shaft of the movable device is positioned below the shredder mechanism.

26. The method according to claim 24, wherein one or more of the radially extending structures comprises at least one surface to catch or redirect shredded materials deposited from the shredder mechanism, and wherein the method comprises directing shredded materials deposited from the shredder mechanism to the output side.

27. The method according to claim 24, wherein one or more of the radially extending structures comprises an elongate structure extending downwardly through the output side and fixed in position on a bottom surface of the radially extending structure, and wherein the method further comprises pivoting each elongate structure with the pivoting of the shaft and distributing an accumulation of shredded materials located adjacent to the output side.

28. The method according to claim 27, wherein the shredder further comprising a bin for receiving shredded materials adjacent to the output side, wherein the radially extending structures of the movable device extend at least partially into the bin, and wherein the method further comprises receiving the deposited shredded material in the bin.

29. The method according to claim 24, wherein the shredder further comprises a frame member forming a passageway from the output of the shredder mechanism to the output side of the shredder housing, wherein the shaft of the movable device is mounted to the frame member, and wherein the method further comprises passing shredded material through the passageway and towards the output side of the shredder housing.

30. The method according to claim 24, wherein the shredder further comprises at least one sensor to detect a presence of shredded materials in relation to the movable device, and wherein the method further comprises detecting a presence of shredded materials in relation to the movable device and activating the pivoting of the shaft of the movable device upon the detection of the presence of shredded materials.

31. The method according to claim 24, wherein the method further comprises determining a slope of an accumulation of shredded materials adjacent to the output side and moving the movable device in a direction so as to distribute the accumulation of shredder materials in the bin based on the determined slope.

32. The method according to claim 24, wherein the pivoting of the shaft of the movable device is activated with the shredding of the material.

33. The method according to claim 24, wherein the pivoting of the shaft of the movable device is activated to move concurrently with the rotating of the cutting assembly.

34. The method according to claim 24, wherein the shredder further comprises a clutching mechanism configured to selectively and temporarily hold the movable device from pivoting from a predetermined position, and wherein the method further comprises selectively and temporarily holding the movable device from pivoting from the predetermined position.

35. The method according to claim 34, wherein the shredder further comprises a bin full sensor or switch to indicate to a user that the bin is full, and wherein the selective and temporary holding of the movable device in the predetermined position activates the bin full sensor or switch.

36. A shredder comprising:

a shredder housing having a shredder mechanism mounted therein, the shredder housing comprising an input opening for receiving materials and an output opening for depositing shredded material therefrom, the output opening being open to an output side of the shredder housing;

the shredder mechanism including a motor and a cutter assembly, the motor rotating the cutter assembly to shred materials fed therein, a movable device positioned at least partially between the shredder mechanism and the output side, the movable device comprising a shaft and one or more radially extending structures extending at least partially radially with respect to the shaft, and wherein the shaft is configured to pivot about an axis parallel to an axis of the cutter assembly in an oscillating manner so as to use the one or more radially extending structures to move shredded materials within and adjacent to the output opening, and a clutching mechanism configured to selectively and temporarily hold the movable device from pivoting from a predetermined position, and wherein the method further comprises selectively and temporarily holding the movable device from pivoting from the predetermined position.

37. The shredder according to claim 36, further comprising a bin full sensor or switch to indicate to a user that the bin is full, and wherein use of the clutching mechanism to selectively and temporarily hold the movable device in the predetermined position is configured to activate the bin full sensor or switch.

38. The shredder according to claim 36, wherein the shaft of the movable device is mounted within or adjacent the shredder housing.

39. The shredder according to claim 36, wherein one or more of the one or more radially extending structures comprises at least one surface to catch or redirect shredded materials deposited from the shredder mechanism.

40. The shredder according to claim 36, wherein one or more of the one or more radially extending structures comprises an elongate structure extending downwardly through the output that is configured to pivot with the shaft and to distribute an accumulation of shredded materials located adjacent to the output side.

41. The shredder according to claim 40, wherein the elongate structure is made from an elastic or rubber material.

42. The shredder according to claim 36, further comprising a bin for receiving shredded materials provided adjacent to the output side and wherein the one or more radially extending structures of the movable device extend at least partially into the bin.

43. The shredder according to claim 42, wherein the one or more radially extending structures of the movable device are configured to engage and move an accumulation of shredded materials positioned in the bin.

44. The shredder according to claim 40, wherein the elongate structure extends at least partially into a bin located below the output side.

45. The shredder according to claim 44, wherein the elongate structure is configured to engage and move an accumulation of shredded materials in the bin.

46. The shredder according to claim 36, further comprising a frame member forming a passageway from the output of the shredder mechanism to the output side of the shredder housing, and wherein the shaft of the movable device is mounted to the frame member.

47. The shredder according to claim 46, wherein the frame member is connected via a hinge to a surface of the shredder housing positioned adjacent to the output of the shredder mechanism, and wherein the frame member is configured to pivot about the hinge to provide access to the output opening and the cutter assembly of the shredder mechanism.

48. The shredder according to claim 47, further comprising one or more switches configured to determine an amount of force applied to at least the frame member, and wherein the pivoting of the frame member about the hinge is automatically triggered upon a predetermined amount of force determined as being applied to at least the frame member.

49. The shredder according to claim 36, wherein the shredder further comprises at least one sensor to detect a presence of shredded materials in relation to the movable device so as to activate the pivoting of the shaft of the movable device upon the detection of the presence of shredded materials.

50. The shredder according to claim 36, wherein the shredder further comprises a plurality of sensors to determine a slope of an accumulation of shredded materials adjacent to the output side.

51. The shredder according to claim 50, wherein the movable device is configured for movement in a direction to distribute the accumulation of shredded materials in the bin based on the determined slope.

52. A method for moving shredded materials in a shredder, the method comprising:

feeding material to be shredded into an input opening in a shredder housing of the shredder;

shredding the material with a shredder mechanism mounted in the shredder housing, the shredder mechanism including a motor and a cutter assembly, the motor rotating the cutter assembly to shred materials fed therein;

depositing the shredded material via an output opening in the shredder housing, the output opening being open to an output side of the shredder housing; and pivoting a shaft of a movable device about an axis that is parallel to an axis of the cutter assembly in an oscillating manner, the movable device being positioned at least partially between the shredder mechanism and the output side and the shaft of the movable device having radially extending structures associated therewith and extending at least partially radially with respect to an axis of the shaft so as to move shredded materials within and adjacent to the output opening, wherein the shredder further comprises a clutching mechanism configured to selectively and temporarily hold the movable device from pivoting from a predetermined position, and wherein the method further comprises selectively and temporarily holding the movable device from pivoting from the predetermined position.

53. The method according to claim 52, wherein the shredder further comprises a bin full sensor or switch to indicate to a user that the bin is full, and wherein the selective and temporary holding of the movable device in the predetermined position further comprises activating the bin full sensor or switch.

54. The method according to claim 52, wherein one or more of the radially extending structures comprises at least one surface to catch or redirect shredded materials deposited from the shredder mechanism, and wherein the method comprises directing shredded materials deposited from the shredder mechanism to the output side.

55. The method according to claim 52, wherein one or more of the one or more radially extending structures comprises an elongate structure extending downwardly through the output that is configured to pivot with the shaft and to distribute an accumulation of shredded materials located adjacent to the output side, and wherein the method further comprises pivoting each elongate structure with the pivoting of the shaft and distributing an accumulation of shredded materials located adjacent to the output side.

56. The method according to claim 55, wherein the shredder further comprises a bin for receiving shredded materials adjacent to the output side, wherein the radially extending structures of the movable device extend at least partially into the bin, and wherein the method further comprises receiving the deposited shredded material in the bin.

57. The method according to claim 52, wherein the shredder further comprises a frame member forming a passageway from the output of the shredder mechanism to the output side of the shredder housing, wherein the shaft of the movable device is mounted to the frame member, and wherein the method further comprises passing shredded material through the passageway and towards the output side of the shredder housing.

58. The method according to claim 52, wherein the shredder further comprises at least one sensor to detect a presence of shredded materials in relation to the device, and wherein the method further comprises detecting a presence of shredded materials in relation to the movable device and activating the pivoting of the shaft of the movable device upon the detection of the presence of shredded materials.

59. The method according to claim 52, wherein the method further comprises determining a slope of an accumulation of shredded materials adjacent to the output side and moving the movable device in a direction so as to distribute the accumulation of shredder materials in the bin based on the determined slope.

* * * * *